US006616380B1

(12) United States Patent
Russell et al.

(10) Patent No.: US 6,616,380 B1
(45) Date of Patent: Sep. 9, 2003

(54) SUBTERRANEAN STRUCTURES AND METHODS FOR CONSTRUCTING SUBTERRANEAN STRUCTURES

(76) Inventors: Matthew F. Russell, 4408 W. Elderberry St., Spokane, WA (US) 99208; Robert L. Russell, P.O. Box 298, Kellogg, ID (US) 83837

( * ) Notice: Subject to any disclaimer, the term of this patent is extended or adjusted under 35 U.S.C. 154(b) by 0 days.

(21) Appl. No.: 10/265,998

(22) Filed: Oct. 7, 2002

Related U.S. Application Data

(60) Provisional application No. 60/385,325, filed on Jun. 3, 2002.

(51) Int. Cl.[7] ..... E02D 17/00
(52) U.S. Cl. ..... 405/229
(58) Field of Search ..... 405/53, 55, 133, 405/229, 267, 268, 270, 272, 274, 275, 282; 52/294, 292, 741.15; 264/34, 35

(56) References Cited

U.S. PATENT DOCUMENTS 3,307,361 A * 3/1967 Waterman ..... 405/55
5,775,043 A * 7/1998 Muroi ..... 52/169.6

FOREIGN PATENT DOCUMENTS

JP 04049324 A * 2/1992 ..... E02D/23/08

* cited by examiner

*Primary Examiner*—Heather Shackelford
*Assistant Examiner*—Lisa M. Saldano
(74) *Attorney, Agent, or Firm*—John S. Reid; Reidlaw, L.L.C.

(57) ABSTRACT

One embodiment of the present invention provides for a subterranean structure, having a continuous ribbon slab having a plurality of flights fabricated from concrete. The ribbon slab defines periodic openings therein which generally align between adjacent flights. Another embodiment provides for a method of fabricating a subterranean structure. The method includes excavating soil to form a downward sloping ramp, and forming a concrete slab on the downward sloping ramp. The method further includes continuing to excavate soil to extend the downward sloping ramp to a location under the concrete slab, and continuing to form the concrete slab on the downward sloping ramp so that a subterranean structure is formed having an essentially continuous concrete slab with a first portion which is above and spaced-apart from a second portion.

10 Claims, 12 Drawing Sheets

SUBTERRANEAN STRUCTURES AND METHODS FOR CONSTRUCTING SUBTERRANEAN STRUCTURES

CROSS REFERENCE TO RELATED APPLICATIONS

This application claims priority to U.S. Provisional Patent Application serial No. 60/385,325, filed Jun. 3, 2002, and entitled "Methods and Apparatus for Constructing Subterranean Structures".

FIELD OF THE INVENTION

The invention claimed and disclosed herein pertains to methods and apparatus for constructing subterranean structures, as for example foundations for buildings, geo-retaining structures, storage containers, tunnels, and other such structures.

BACKGROUND OF THE INVENTION

There are a number of prior art methods for constructing subterranean walls and other subterranean structures. Prior-art soil-nailed walls achieve the same end of constructing a subterranean "wall", but the method requires relatively long "nails" (deweydag rods or post tensioning tendons) to be anchored far into adjacent terrain and at relatively high cost. Such soil-nailed walls also require that one side of the "wall" be excavated to drill and insert the soil nails. Another method of forming subterranean walls in-situ is to excavate a deep trench while simultaneously filling the trench with a dense but flowable media (such as mud) to retain the soil on either side of the trench until such time as concrete placed in the trench is consolidated into the trench using a tremie and the concrete displaces the dense media. This method, called "slurry trenching", is relatively costly and it is difficult to control construction quality since there is no access to the depths of the dense media. Typically, subterranean tanks or holding vessels are constructed by slurry trenching where ground conditions require it and then soil nailing as the excavation within this slurry trench wall system progresses. Afterwards a concrete and/or steel tank is constructed within the confines of this soil nailed and shotcreted tank cavity. (Shotcrete is a method of typically applying concrete to a generally vertical surface by projecting or "blasting" concrete onto the surface.) Subterranean tanks can also be constructed by over-excavating, then constructing a tank in the over-excavated area (as would be done above ground), and then compacting earth back around the tank. Both of these methods are relatively costly and require that excavation for the tank be done before or in conjunction with the construction of the wall. In no case with the current art can a tank or retained space be excavated for after-construction of the walls with the exception of the trench wall described above. Large retaining structures such as deep cuts for freeways and the like are typically performed using soil-nailing or with mechanical structured earth walls.

One major problem with the current art of soil nailing a large excavation is that the open face of the excavation (i.e., the exposed perimeter of the excavation below the current nailing and shotcrete level) makes it difficult to control the inflow of groundwater to the excavation before it can be sealed. Another significant disadvantage of soil nailing is that it is a costly method of stabilizing ground conditions or retained earth, especially when ground water in conjunction with non-cohesive soils requires that a slurry trench be used as a pre-stabilizer so that excavation and subsequent soil nailing can proceed. Soil nailing is also a relatively time consuming process since deep excavations often require soil nails in a closely-spaced pattern, which requires an extensive amount of drilling.

There is no prior art method for tying together or bracing caissons or cast-in-place or driven piles beneath the surface, as for example columns are analogously braced against buckling above ground with floor diaphragm beams and bracing members. Nor is there a current economic method of creating a mass or mono-caisson foundation with a plurality of caissons or piles. Nor is there currently a method of constructing foundations while simultaneously constructing the intended structure(s) upon the foundation.

SUMMARY OF THE INVENTION

One embodiment of the present invention provides for a subterranean structure having a continuous ribbon slab having a plurality of flights fabricated from concrete. The ribbon slab defines periodic openings therein which generally align between adjacent flights.

Another embodiment of the present invention provides for a method of fabricating a subterranean structure. The method includes excavating soil to form a downward sloping ramp, and forming a concrete slab on the downward sloping ramp. The method further includes continuing to excavate soil to extend the downward sloping ramp to a location under the concrete slab, and continuing to form the concrete slab on the downward sloping ramp so that a subterranean structure is formed having an essentially continuous concrete slab with a first portion which is above, and spaced-apart from, a second portion of the slab.

A further embodiment of the invention provides for a structure having a building and a foundation which supports the building. The foundation includes a continuous ribbon slab having a plurality of flights fabricated from concrete.

Yet another embodiment of the invention provides for a method of supporting a secondary structure. This method includes forming a plurality of generally vertically aligned concrete slabs having an uppermost slab and a lowermost slab, and supporting the secondary structure on the uppermost slab. The secondary structure can also be supported indirectly on the uppermost slab by placing a tertiary structure, such as a concrete slab, between the secondary structure and the uppermost slab.

These and other aspects and embodiments of the present invention will now be described in detail with reference to the accompanying drawings, wherein:

DETAILED DESCRIPTION OF THE INVENTION

Figure 1:
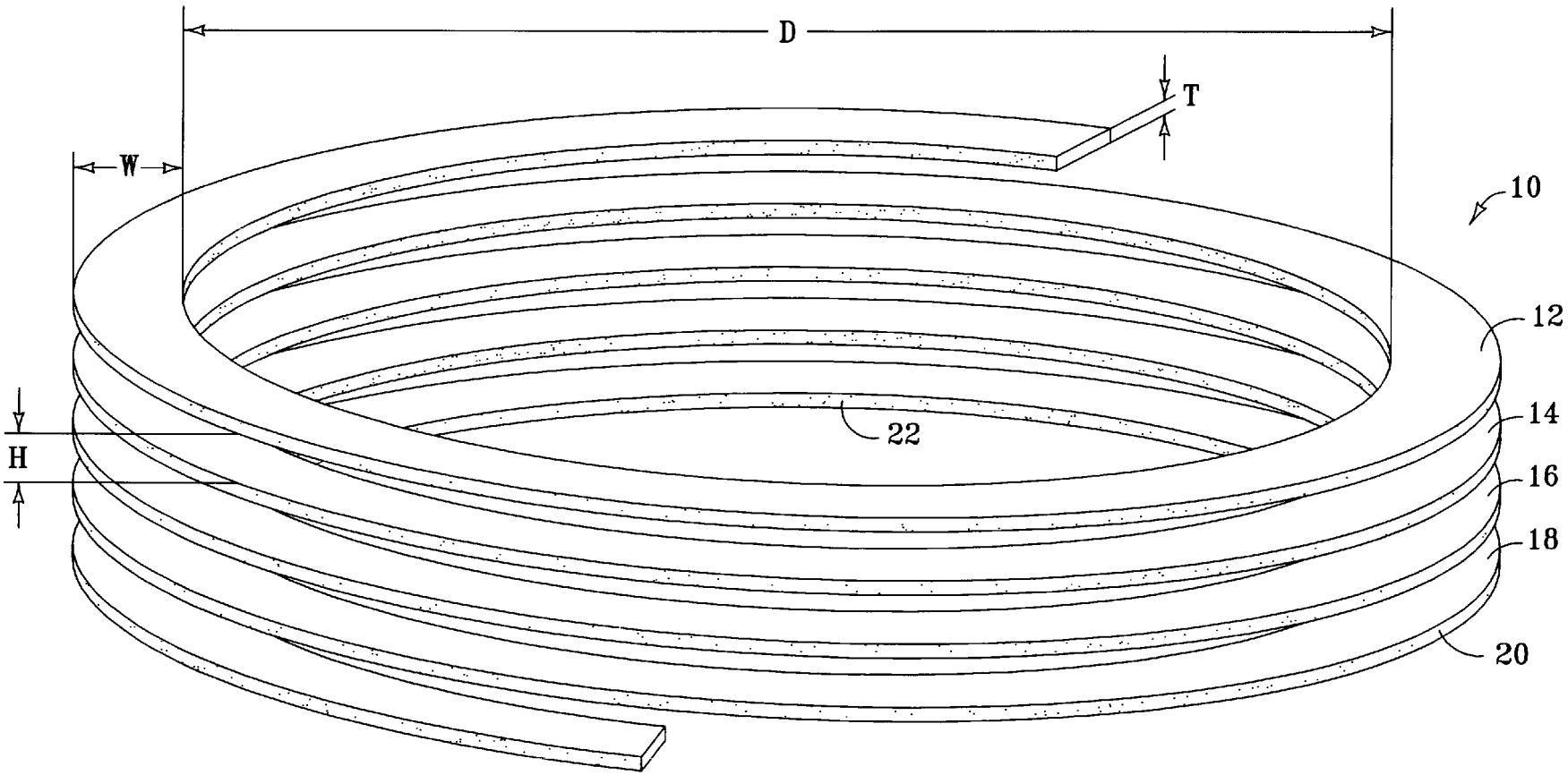
FIG. 1 is a three dimensional diagram depicting a spiral slab, such as a concrete slab, which can be used in certain embodiments of the present invention.

The present invention relates generally to a method and apparatus for constructing ribbon slab, reinforced concrete, subterranean structures such as foundations, subterranean holding vessels, subterranean access and passageways, retaining structures, and earthen or structural columns. The method relates more specifically to the continuous (spiraling) or discrete (level-by-level) descending progression of tunneling and casting of vertically consecutive, typically parallel (i.e., aligned), ribbon slabs. These vertically consecutive or repeating slabs can be used to provide vertically periodic lateral rigidity to cast-in-place caissons, as well as to steel or concrete columns erected within the voids where cast-in-place caissons would ordinary be poured. Further, when bridged one to the other vertically with walls on one or both sides (or filled in-between), the slabs can be used to form hollow core or solid, thick-shell walls which can be used to retain earth and contain liquids by means of out-of-plane flexural and transverse shear rigidity, compressive or tensile hoop rigidity, or a combination thereof as is provided by thick-shell structural element theory. The method includes construction of vertically consecutive but non-spiraling ribbon slabs (level-by-level), compound slope or super elevation of ribbon slabs, complex aggregate shell geometries (spiraling larger or smaller which affects sectional profile geometry of the wall), and ascending progression of the structure in addition to a descending progression of the structure.

Exemplary uses for structures formed by selected methods of the present invention include, but are not limited to: (1) tied caisson foundations; (2) cylindrical, conical, or pyramidal mono-caissons (among other geometries); (3) seepage liners below earthen dams; (4) construct-and-uncover walls and retaining walls; (5) subterranean tanks, silos, and glory holes; (6) retained earth columns and earth confinement; (7) access or purposeful passageways such as spiral ladders or ramp systems for aquaculture (e.g. fish ladders), electromagnetic passageways such as for physics experimentation (such as a super-collider), livestock access, and hydraulic-based flow, drainage, and processing systems; and (8) large bore shafts, raises, and steep-walled pits, among other mining and heavy civil engineering type applications. Specific attributes of the methods and resultant structural properties make embodiments of the present invention suited to environmental mitigation such as construction of subterranean capture around buried or ground infiltrated hazardous waste. Methods and resulting structures of embodiments of the present invention also provide economical subterranean containment vessels for short and long-term storage of nuclear waste which allow complete monitoring access around the perimeter of the contained material (for example, a honeycomb structure provides complete access to the perimeter of the structure) and, in the case of the use of vertical curve capability of the invention, containment and monitoring below the contained material as well as around it.

The present invention allows braced-caisson or cast-in-place pile foundations to be economically built to great depths. Further, since a mass-caisson or mono-caisson foundation is inherently created with the method of this invention when spiraling slabs are produced, the slabs not only periodically laterally brace the caissons which are poured after the subterranean structure is constructed, but since the structure will typically be post-tensioned, it will compress and contain soil within the structure in a manner similar to sand being contained within a barrel, making the contained material essentially rigid and capable of carrying vertical loads to the strata below the contained earth. This allows the structure to act as a foundation resistant to the effects of liquefaction and the resultant deleterious amplitude modulation which can occur during an earthquake in liquefiable soils. As used herein, "soil" includes all earthen materials, including dirt, rock, aggregates, clays, and other material commonly encountered when excavating below the surface of the earth.

A further advantage of the present invention is that, by comparison to open-excavation construction of subterranean walls, in the present invention very little face is exposed to inflow of ground water during the construction process, thus significantly reducing the need to capture and treat recovered excavation water. In addition, excavation for tanks or retained-space uses can be performed after the subterranean retaining walls are constructed, thus allowing the excavation to progress more efficiently without being hindered by the inflow of groundwater. In one example, described below, it will be seen that the present invention also allows excavation to take place concurrently with the construction of the subterranean retaining wall. That is, the method of foundation construction in accordance with certain embodiments of the present invention is such that there is essentially always full bearing of the structure on the subjacent earth (with the exception of a small working void within the ground), as well as confinement of the contained earth within the foundation perimeter, thus making it possible to simultaneously construct a significant part of the structure supported by the foundation. As will be described below, the foundation wall can be made to have residual void-space so that access to all levels of the foundation for inspection purposes can be provided.

In a broad sense, certain embodiments of the present invention provide for a subterranean structure which includes a continuous ribbon slab having a plurality of flights fabricated from concrete. Turning to FIG. 1, a continuous ribbon slab 10 in accordance with an embodiment of the invention is depicted in an isometric diagram. It is understood that preferably most or all of the ribbon slab 10 is located in a subterranean location (i.e., "underground", or below the surrounding grade). The ribbon slab 10 includes a plurality of generally concentric flights 12, 14, 16 and 18, which are depicted here as having a common inside diameter "D" which is defined by an inner perimeter 22 of the flights.

The area within the inside diameter of the flights 12, 14, 16, 18 can remain filled with surrounding earth, or it can be excavated after (or as) the ribbon slab 10 is constructed. Likewise, the area outside of the ribbon slab 10 (i.e., the area outside of the outer perimeter line 20) can remain as solid earth or it can be excavated after (or as) the ribbon slab 10 is constructed. The inside diameter "D" of the flights 12, 14, 16, 18 can be constant or variable, as can the thickness "T" of the slab 10, the width "W" of the slab, and the spacing "H" between the flights 12, 14, 16, 18. We will use the expression "slab interval" to mean the vertical distance "H" between immediately adjacent flights 12, 14, 16, 18 of the continuous ribbon slab 10. Preferably, the ribbon slab 10 is formed from concrete, which can be reinforced, post-tensioned concrete.

Preferably, the ribbon slab 10 is constructed in a top-down manner. That is, flight 12 is formed first, then flight 14, and so on in a descending manner. Essentially, the method of placing the ribbon slab 10 can be considered as tunneling downward in a spiral, and laying concrete on the tunnel floor as the tunnel is formed. The tunnel is defined by height "H" and width "W". Generally, the tunnel will be defined by walls along the outer perimeter 20 and inner perimeter 22 of the flights 12, 14, 16, 18. The walls can be defined by the natural surrounding rock or soil, by sheet piling, or by wall members which are placed during construction of the continuous ribbon slab 10. The ribbon slab 10 is preferably constructed in a generally continuous manner (versus as integral flights), although this is not essential. Further, as the ribbon slab 10 is being constructed, the area between the flights 12, 14, 16, 18 is preferably back-filled with earth or concrete to thereby allow a subjacent flight to support the flight above it. That is, for example, as flight 14 is being formed, the region (defined by height "H" and width "W") between the bottom of flight 12 and the top of flight 14 is filled with material so that flight 14 supports flight 12. Then, as flight 16 is being formed, the area between flight 14 and flight 16 is back-filled so that flight 16 supports flight 14, and so on. There will, of course, be a relatively small work area between the two lowermost adjacent flights (as will be described later) that is not filled as work is being performed to advance the "tunnel" (and thus the slab 10) into the earth. If calculations determine that the surrounding soils and the loads on the above flight (e.g., flight 12) are such that the portion of the-above flight in the work area is not self-supporting, then that portion of the above flight can be temporarily supported on the immediate flight (e.g., flight 14) by jacks or the like. Further, the above flight (e.g., flight 12) can be supported in the work area by sheet piling which defines the walls of the tunnel, and which extends downward into the strata below the work area. It will occur that if the area "H" between the flight 12, 14, 16, 18 is completely backfilled over the width "W" of the slab 10 as lower flights are constructed, and if the outer perimeter 20 of the flights, and the inner perimeter 22 of the flights, are closed (such as by adjacent rock, soil or sheet piling) then a means needs to be provided to allow excavated soil to be removed from the descending tunnel, and to allow worker access to the work area. In this instance, periodic, generally aligned openings (not shown in FIG. 1) can be formed in each of the flights, and a sleeve can connect the openings to thereby form raiseways or caissons in the evolving structure. (A "raiseway" is a passageway which can be used to pass materials out of, and into, the work area from the upper surface, or from an upper level of the evolving structure.)

While the ribbon slab 10 of FIG. 1 is depicted as being circular in shape in plan view, this is not a requirement. The plan view of a subterranean structure in accordance with the present invention can also be a polygon, an ellipse, or any other convenient shape. Further, and as will be described more fully below, a subterranean structure in accordance with the present invention can include a plurality of interleaved continuous slabs. When we use the term "continuous slab" we mean that the slab has at least some physical continuity along the length of the slab. For example, where the slab is continuously poured from concrete, then the slab will be a continuous, integral slab of concrete. However, in many instances it will be more practical to pour sections of concrete and then join the sections together such as with reinforcing steel and/or (and more preferably), with post-tensioning cables.

While one or more continuous slabs can be used in many embodiments of the present invention, in other embodiments (described more fully below) the slabs do not need to be continuous, but only adjoined, such as by an access ramp or passageway (which can be temporary or permanent) allowing access from an upper slab to a lower slab. In this latter configuration the slabs are preferably generally concentric, and are also preferably generally aligned between adjacent slabs. However, the criteria of "generally aligned" should be considered as embracing adjacent slabs that are somewhat different in inside and/or outside dimensions (e.g., inside dimension "D" of FIG. 1), as well slabs that are somewhat different in width (e.g., width "W" of FIG. 1).

Figure 2:
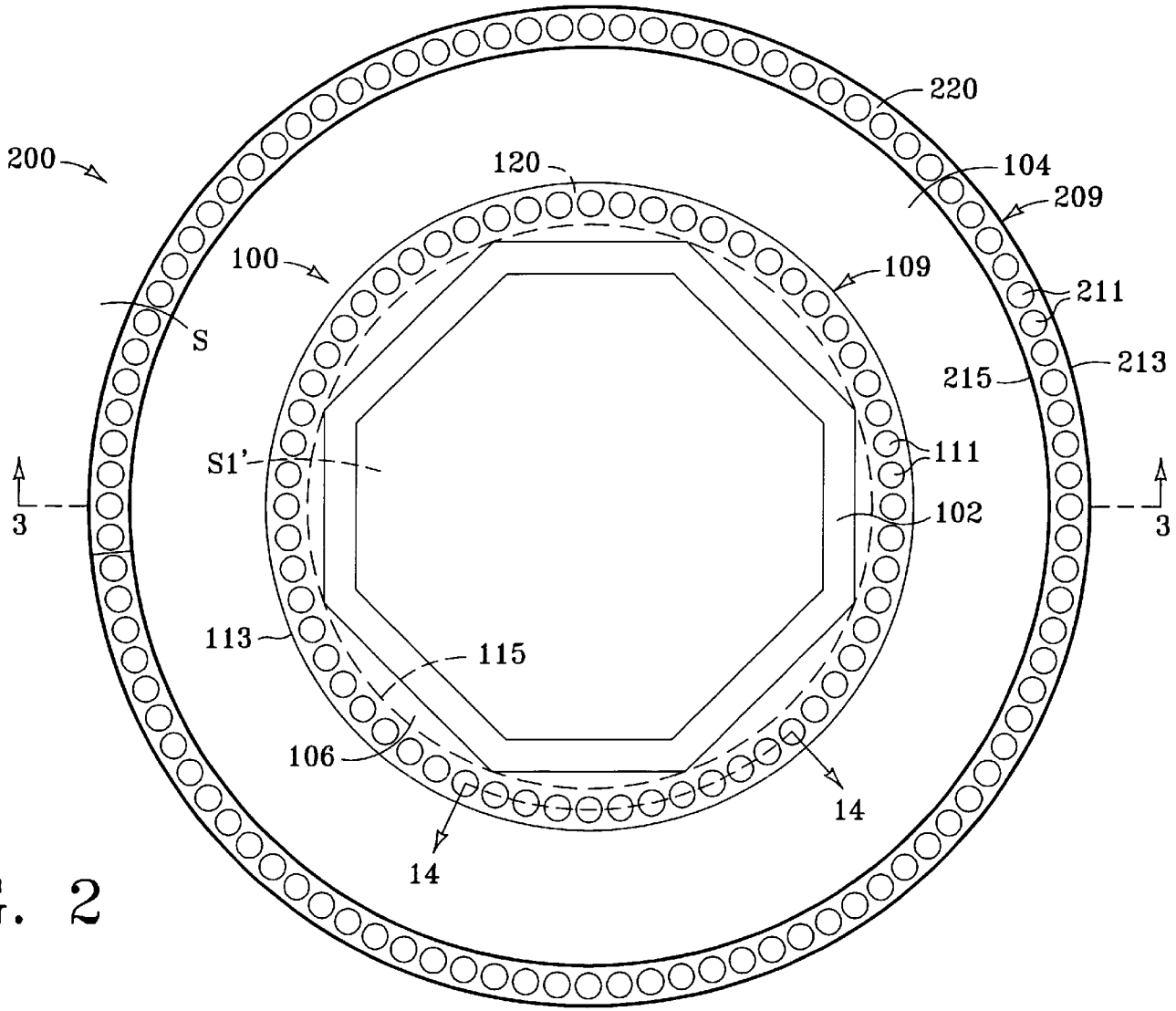
FIG. 2 is a plan view depicting subterranean structures in accordance with embodiments of the present invention.

Turning now to FIG. 2, a plan view of a first embodiment of the present invention is depicted. Shown in FIG. 2 is a first subterranean structure 100 which forms a foundation for a supported secondary structure 102, which can be a building or the like. The supported structure 102 can be supported on the foundation 100 by a foundation cap 106 which rests on the foundation 100. In one variation, the secondary structure can be indirectly supported on the foundation 100 by an intermediate slab. In yet another variation, the structure 100 can extend from below the surface to a distance above ground, in which case the "secondary structure" is essentially an extension of the foundation portion 100. The surrounding soil or ground "S" can be isolated from the foundation 100 by a retaining wall 200, thereby forming an intermediate zone 104. The soil in the intermediate zone 104 can be left in place, or it can be excavated (removed) to form a voidspace, which can be used for example as a parking area for the supported secondary structure 102. Further, a concrete cap or grade slab (not shown) can also be placed between the retaining wall 200 and the foundation 100. Foundation 100 and retaining wall 200 can be formed in accordance with methods of the present invention. Since the foundation 100 and the retaining wall 200 are subsurface structures which are formed in place, and are preferably formed from reinforced concrete ribbon slabs, these structures can be properly identified as "cast-in-place reinforced subterranean structures".

As depicted, retaining wall 200 is formed from a continuous ribbon slab 209 having multiple flights, of which only the uppermost flight 220 can be seen in FIG. 2. The continuous ribbon slab 209 is defined by an outer perimeter 213 and an inner perimeter 215. A plurality of openings 211 are formed in the flights (only flight 220 is depicted), the function of which will be more fully described below, except that the openings 211 can generally be described as defining construction access raiseways in the retaining wall structure 200. Similarly, foundation 100 is formed from a continuous ribbon slab 109 having multiple flights, of which only the uppermost flight 120 can be seen (under cap 106) in FIG. 2. The continuous ribbon slab 109 is defined by an outer perimeter 113 and an inner perimeter 115. A plurality of periodic openings 111 are formed in the flights (only flight 120 is depicted), which can generally be described as defining construction access raiseways in temporary use and caissons in permanent use in the foundation similar to openings 211 in retaining wall structure 200.

Foundation 100 can be described variously a "tied caisson foundation", "honeycomb wall foundation", "hollow wall foundation", or "solid wall foundation", depending on details of construction of the foundation 100. "Tied caisson" means the caissons (defined by openings 111) are laterally braced intermittently at discrete ribbon slab (109) levels, or continuously in the case of having the tunnel voids (briefly described above, and more fully describe below) completely filled between caissons. "Honeycomb wall foundation" means that caisson liners (which are not shown in FIG. 2, but are described more fully below, and generally define the openings 111) are not filled, the "honeycomb" nature being considered sheet piling, for example (placed around peripheries 113 and 115 along the vertical height of the foundation 100, and described more fully below), or a wall that can be cast or shotcreted just inside of the sheet piling (i.e., in the "tunnel" defined between the flights) to continuously support the spiraling ribbon slab 109 all the way down to bearing strata or, depending on the profile, through friction support within the soil profile. "Solid wall foundation" means that the caisson liners (described below) are filled and the tunnel void spaces between adjacent caisson liners are also filled, or that no caisson liners are installed and the entirety of the void space in the tunnel between sheet piled walls is filled with concrete, shotcrete, or some type of engineered fill such as sand-cement slurry.

Likewise, retaining wall 200 can be variously described as a "chambered retaining wall", "hollow retaining wall", or "solid retaining wall" depending on details of construction of the retaining wall 200. "Chambered retaining wall" means that the caisson liner part (described below, and used to define opening 211) is filled with concrete to increase the strength of the retaining wall 200. "Hollow retaining wall" means that either there is no shotcrete, concrete, or engineered fill within the tunnel void space created between the sheet piling (described below) and the spiral ribbon slab 209, or there can be a wall cast against the sheet pile but that there is a tunnel void space defined between these walls and the spiral ribbon slab 209. "Solid retaining wall" means the same as for the solid foundation wall described above with respect to foundation 100. It will be appreciated that the ribbon slabs 109, 209 used in the foundation 100 and retaining wall 200 provide significant resistance to out-of-plane bending and also provide transverse shear rigidity such that these type of walls can be used to retain soil to extreme depths and to brace caisson foundations even within liquefiable soils. In the latter case, the "mono-caisson approach" (depicted in FIG. 2) affords a foundation 100 which will resist the liquefaction of the captured soil S1' (beneath cap 106) during an earthquake because the captured soil is maintained in a state of triaxial compression within the limits of the spiral wall foundation 100.

Figure 3:
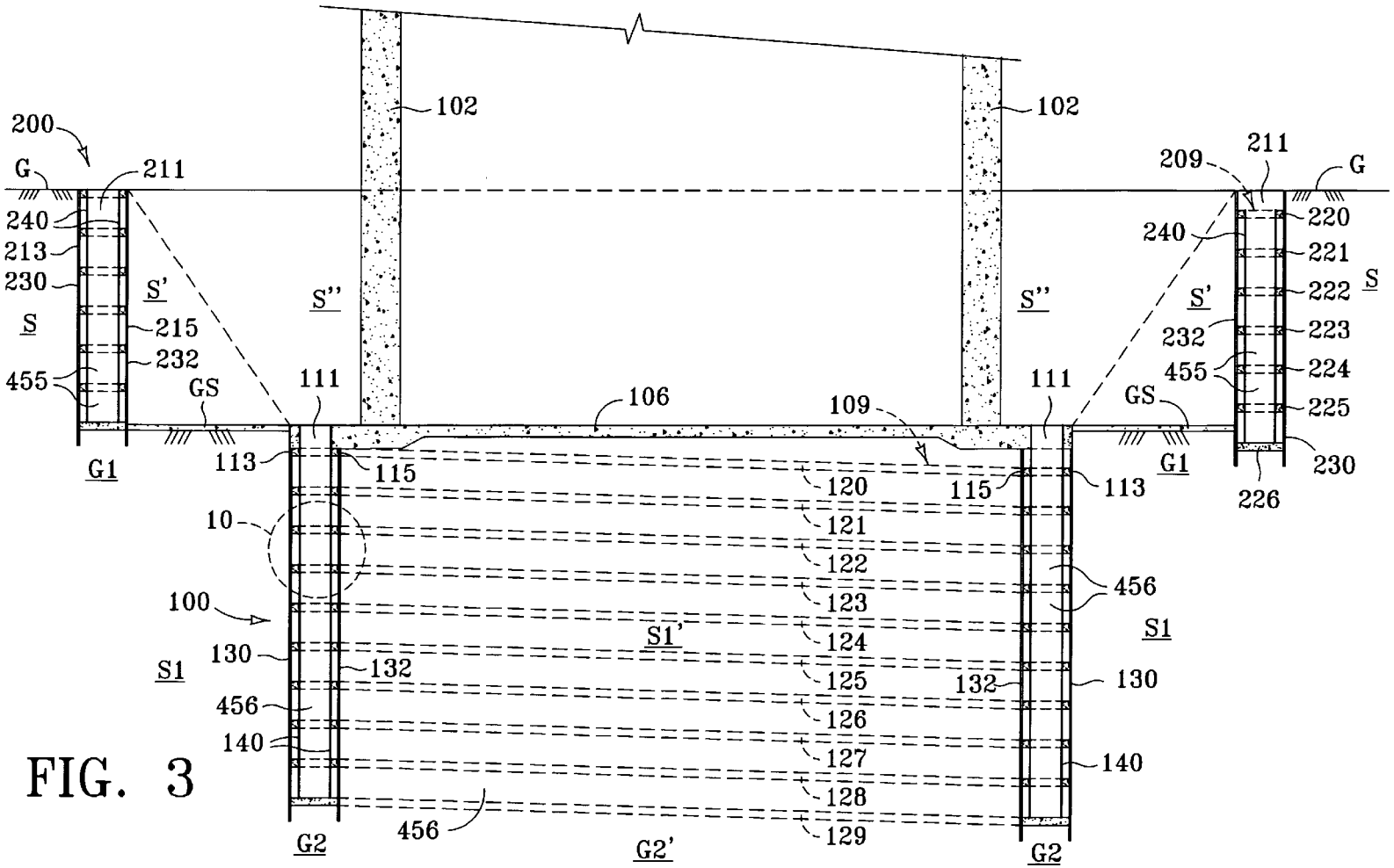
FIG. 3 is a side elevation sectional view of the subterranean structures depicted in FIG. 2.

Turning now to FIG. 3, a side elevation sectional view of the foundation 100 and retaining wall structure 200 of FIG. 2 is depicted. As can be seen, foundation cap 106 rests on foundation 100 and supports secondary structure 102, which can be a building, for example. Foundation 100 is set below the ground level G, and rests on foundation ground G2 and G2', thus separating captured soil S1' from outer free soil S1. Retaining wall 200 is supported by ground G1 upon which ground slab GS can be formed, as from concrete or the like. Retaining wall 200 captures soil S' and S", and separates this captured soil from the free soil S. It will be appreciated that soil S1' is captured inside of tied caisson foundation 100 and is analogous to sand in a steel barrel. This foundation 100 can be also called a "mono-caisson" foundation in that the spiral ribbon slab 109, being typically post tensioned, confines the soil S1' within its perimeter and in so doing causes the foundation 100 to act like both a continuous support wall bearing on strata G2 but also a singular foundation bearing also on strata G2'. Transfer of load to strata G2' occurs as the soil S1' is tri-axially strained. This strain occurs for two reasons: (1) settlement of the caisson wall foundation 100 and foundation cap 106, and (2) tensioning of the tendons (described below) within the spiral slab 109. Although the structure 102 is depicted as being supported on the foundation cap 106 somewhat inward of the inner periphery 115 of foundation 100 (see also FIG. 2), the structure 102 can also be supported directly over the area of the foundation 100 between the outer periphery 113 and the inner periphery 115. In this latter configuration the structure 102 can inhibit access to the openings 111. If the structure 102 does inhibit access to the openings 111, then either the foundation 100 will need to be constructed prior to constructing the structure 102, or means will need to be provided (such as side access to openings 111) to allow construction of the foundation 100 to proceed notwithstanding the positioning of the structure 102 directly over the foundation 100.

The structures 100 and 200 are essentially subterranean "walls". "Subterranean" as used herein essentially means that the structures 100, 200 are constructed within soil or below grade and will typically have soil remaining on one or both sides of the continuous walls which define the structures after construction is accomplished and any adjacent excavation is accomplished. For example, retaining wall 200 is accomplished by constructing it in a descending spiral fashion through soil that it divides into soil regions S and S' (and including S"). In a like manner, foundation 100 divides the regions S1 and S1'. It will be appreciated that there are cases where a free-standing wall or retaining wall can be more economically constructed in accordance with a subterranean method of construction of the present invention, but it can be uncovered for all or part of its height on both sides of the wall. It will also be appreciated that construction of both the retaining wall 200 and foundation 100 can proceed simultaneously by first excavating soil S", and leaving soil S' so that retaining wall 200 can be accomplished in this subterranean fashion. After construction of the retaining wall is complete, soil S' can be excavated and grade slab "GS" can be poured. It will also be appreciated that after accomplishing the first full spiral or flight 120 of the ribbon slab 109 of foundation 100, foundation cap 106 can be poured and casting of structure 102 can proceed simultaneous with the construction of foundation 100 provided there is no deleterious settlement of the foundation 100, cap 106, or secondary structure 102, and so far as the foundation 100 and its cap 106 are structurally adequate at all phases of construction to carry the loads imposed by the growing structure 102.

As indicated, retaining wall 200 includes a continuous ribbon slab 209 which is circular in plan view and which "spirals" into soil S in the manner depicted in FIG. 1. Preferably, the ribbon slab 209 is fabricated from concrete. As depicted, ribbon slab 209 forms seven concentric, generally vertically aligned flights 220 through 226. Each of the flights 220–226 are closed with the immediately above and subjacent flight (where applicable) at the outer perimeter 213 by a first wall member. In the example depicted in FIG.

3, the first or outer wall member is outer sheet piling 230. Likewise, each of the flights 220–226 are closed with the immediately above and subjacent flight (where applicable) at the inner perimeter 215 by a second or inner wall member, which in the example depicted is inner sheet piling 232. For clarity, flights 220–226 are not indicated by hidden lines as they continue around behind structure 102, but they would appear similar to the hidden lines shown for flights 120–129 for foundation 100, as described below.

The spiral flights 220–226 and the wall members 230 and 232 define a continuous tunnel 455 which "spirals" downward from flight 220 to flight 226. Each of the flights 220–226 can have one or more openings (not specifically called out) defined therein, which generally align with similar openings in immediately-above or subjacent flights (as appropriate) to thereby connect the adjacent levels of the tunnel 455. Caisson liners 240 (described more fully below with respect to caisson liners 140 of foundation 100) can be placed within the openings in the flights 220–226 to thereby form a plurality of caissons 211 in the retaining wall 200. The function of these caissons 211 will be described more fully below, but they can generally be used to provide access to lower flights 221–226 of the spiral slab 209.

In a manner similar to retaining wall 200, foundation 100 includes a continuous ribbon slab 109 which is circular in plan view and which "spirals" into soil S1 in the manner depicted in FIG. 1. Preferably, the ribbon slab 109 is fabricated from concrete. As depicted, ribbon slab 109 forms ten concentric, generally vertically aligned flights 120 through 129. Each of the flights 120–129 is closed with the immediately above and subjacent flight (where applicable) at the outer perimeter 113 by a first wall member. In the example depicted in FIG. 3, the first or outer wall member is outer sheet piling 130. Likewise, each of the flights 120–129 is closed with the immediately above and subjacent flight (where applicable) at the inner perimeter 115 by a second or inner wall member, which in the example depicted is inner sheet piling 132.

The spiral flights 120–129 and the wall members 130 and 132 of the foundation 100 define a continuous tunnel 456 which "spirals" downward from flight 120 to flight 129. Each of the flights 120–129 can have one or more openings (not specifically called out) defined therein, which generally align with similar openings in immediately-above or subjacent flights (as appropriate) to thereby connect the adjacent levels of the tunnel 456. Caisson liners 140 (described more fully below) can be placed within the openings in the flights 120–129 to thereby form a plurality of caissons 111 in the foundation 100. The function of these caissons 111 will be described more fully below, but they can generally be used to provide access to lower flights 121–129 of the spiral slab 109.

The method of construction of foundation 100 will be described more fully below, along with details of specific design components for the foundation 100.

Turning now to FIGS. 4 through 9, a number of variations of a subterranean structure in accordance with embodiments of the present invention are depicted. The views in FIGS. 4–9 generally correspond to the left side of the foundation 100 depicted in FIG. 3. That is, FIGS. 4–9 depict partial side sectional views through a circular (in plan view) subterranean structure similar to structure 100 of FIG. 3. Each structure 300, 320, 340, 360, 380 and 390 in FIGS. 4–9 includes a spiral slab (respectively, 301, 321, 341, 361, 381 and 391) which forms ten generally concentric flights (which are numbered in the figures as will be described more fully below). All of the flights in each structure 300, 320, 340, 360, 380 390, except for the lower-most flight, have generally aligned openings defined therein, similar to flights 120–128 of FIG. 3. Each structure in FIGS. 4–9 is depicted as having a foundation cap 306 which is supported by the structure, and a secondary structure 102 (such as identical structure 102 of FIGS. 2 and 3) is supported on the foundation cap 306. The variations in FIGS. 4–9 depict how various construction parameters can be varied in constructing subterranean structures in accordance with embodiments of the present invention.

Figure 4:
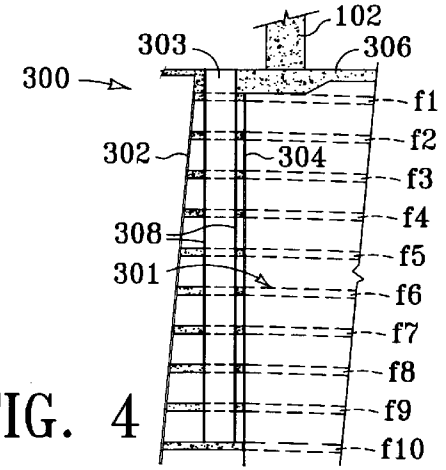
FIGS. 4 through 9 are partial, side elevation sectional views depicting variations of one of the subterranean structures depicted in FIGS. 2 and 3 in accordance with embodiments of the present invention.

With respect to FIG. 4, a structure 300 includes a spiral ribbon slab 301 having flights f1 through f10. The outer perimeters of the flights f1–f10 are joined together by outer sheet piling 302, while the inner perimeters of the flights are joined together by inner sheet piling 304. A caisson liner 308 passes through the openings in each flight f18 f9 to thereby form a caisson 303 (similar to caisson 111 of FIG. 3). As can be seen, the width of each flight f2–f10 is slightly wider than the width of the immediately-above flight. This can be accomplished by continuously increasing the width of the ribbon slab 301 as the slab descends from flight f1 to flight f10. Alternately, the width of the ribbon slab 301 can be periodically incremented as the slab descends. It will be noted that the width dimension is increased only at the outer perimeter of the slab 301 adjacent to sheet piling 302. There are several reasons for increasing the structural section (i.e., width of the slab) with depth while keeping the internal radius (i.e., the inner perimeter adjacent to sheet piling 304) constant. These include: (1) earthen pressures within the captured soil inside the large mono-caisson structure 300 increases with depth, and therefore post tension strands in the slab 301 (described more fully below) can require more concrete to handle the larger pre-stress loads; (2) localized out-of-plane load on the foundation 300 can require a high sectional modulus to withstand the effects of partial liquefaction of the soil surrounding the mono-caisson (i.e., the area outside of the outer perimeter of the foundation 300, defined by sheet piling 302); and (3) if the structure 300 is a retaining wall around a tank within the inner perimeter area (defined by sheet piling 304), it will more practically be of a constant internal radius.

Figure 5:
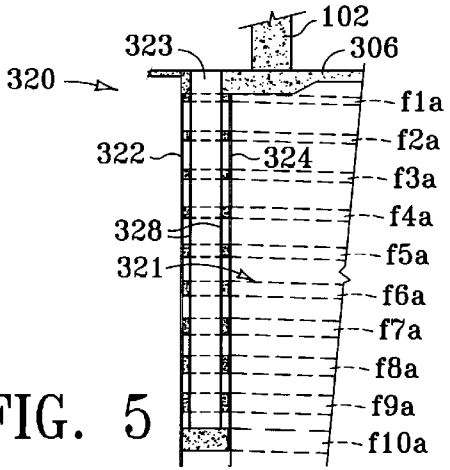

In FIG. 5 an alternate way of achieving more structural section with depth (similar to the objective of the design of structure 300 of FIG. 4), is depicted, but the objective is achieved without changing the internal or external radii of the structure. In FIG. 5, a structure 320 includes a spiral ribbon slab 321 having flights f1*a* through f10*a*. The outer perimeters of the flights f1*a*–f10*a* are joined together by outer sheet piling 322, while the inner perimeters of the flights are joined together by inner sheet piling 324. A caisson liner 328 passes through the openings in each flight f1*a*–f9*a* to thereby form a caisson 323 (similar to caisson 111 of FIG. 3). As can be seen, the thickness (equivalent to thickness "T" of spiral slab 10 of FIG. 1) of each flight f2*a*–f10*a* is slightly wider than the thickness of the immediately-above flight. This can be accomplished by continuously increasing the thickness of the ribbon slab 321 as the slab descends from flight f1*a* to flight f10*a*. Alternately, the thickness of the ribbon slab 321 can be periodically incremented as the slab descends. A further means of increasing effective out-of-plane rigidity is to decrease the interval between slab flights as the spiral descends, i.e., varying the dimension "H" as given in FIG. 1, holding the slab thickness "T" constant or in conjunction with varying slab thickness "T" of FIG. 1.

Figure 6:
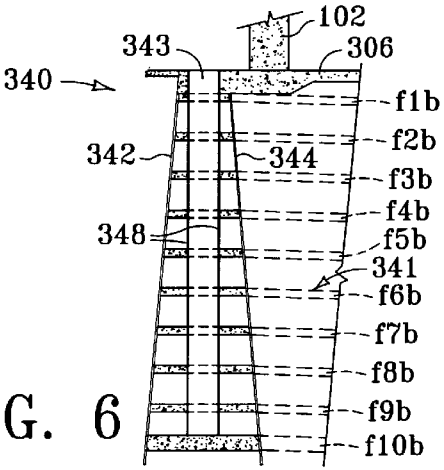

Turning to FIG. 6, a structure 340 includes a spiral ribbon slab 341 having flights fib through f10*b*. The outer perimeters of the flights f1*b*–f10*b* are joined together by outer sheet piling 342, while the inner perimeters of the flights are joined together by inner sheet piling 344. A caisson liner 348 passes through the openings in each flight f1*b*–f9*b* to thereby form a caisson 343. As can be seen, the width of each flight f2*b*–f10*b* is slightly wider than the immediately-above flight, similar to flights f2–f10 of FIG. 4. However, in FIG. 6 the width of the flights f2*b*–f10*b* is increased around both sides of the centerline of the caisson liner 348. That is, the width dimension of the ribbon slab 341 is increased at the outer perimeter of the slab 341 (adjacent to sheet piling 342), as well as at the inner perimeter of the slab 341 (adjacent to sheet piling 344). The main purpose for the configuration depicted in FIG. 6 is to increase substantially the end bearing potential of the mono-caisson foundation 340. In this case, "flaring" the ribbon slab 341 continuously about the centerline of the caisson 343 affords a larger bearing area of slab 341 under the ends of each of the caissons 343 which make up this mono-caisson foundation 340.

It will be appreciated that the profile of the foundation 100 depicted in FIG. 3, as well as the profiles of structures 300, 320 and 340 depicted in FIGS. 4–6, imply that the ribbon slabs which make up these structures can be varied in a wide variety of ways to achieve virtually any wall profile required for the particular application, including the ability to produce curvilinear profiles as well as constant slope profiles.

Figure 7:
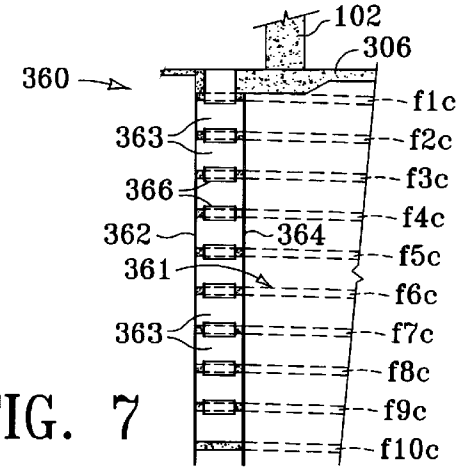

Turning now to FIG. 7, a structure 360 includes a spiral ribbon slab 361 having flights f1*c* through f10*c*. The outer perimeters of the flights f1*c*–f10*c* are joined together by outer sheet piling 362, while the inner perimeters of the flights are joined together by inner sheet piling 364. The structure 360 of FIG. 7 is similar to the structure 100 of FIG. 3, except that in the structure 360 the caisson liners 366 do not extend continuously from flight f1*c* to f10*c* (whereas in FIG. 3 the caisson liner 140 does extend continuously from flight 120 to flight 129). In the structure 360 of FIG. 7 the ribbon slab 361 relies essentially only on the sheet piling 362, 364 for vertical support until such time as the tunnel void space 363 is back-filled in part or in full such that the back-fill supports the ribbon slab 361.

Figure 8:
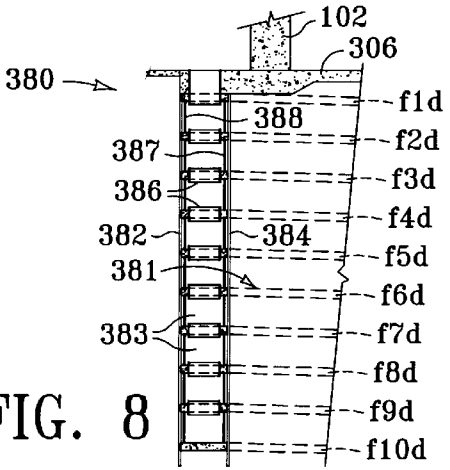

Turning to FIG. 8, a structure 380 includes a spiral ribbon slab 381 having flights f1*d* through f10*d*. The outer perimeters of the flights f1*d*–f10*d* are joined together by outer sheet piling 382, while the inner perimeters of the flights are joined together by inner sheet piling 384. The structure 380 of FIG. 8 is similar to the structure 360 of FIG. 7 in that the caisson liners 386 of the structure 380 do not extend continuously from flight f1*d* to f10*d*, thus leaving tunnel voids 383. However, whereas the structure 360 of FIG. 7 relies essentially only on the sheet piling 362, 364 to temporarily support the ribbon slab 361, the structure 380 of FIG. 8 additionally relies on wall members 387 and 388 to support the ribbon slab 381. Wall member 387 is attached to the inner sheet piling 384 and faces the inner perimeter of the flights f1*d*–f10*d*, while wall member 388 is attached to the outer sheet piling 382 and faces the outer perimeter of the flights. While typically the tunnel area 383 of structure would be backfilled, this is not a necessity, and the wall members 387, 388 can be the primary support for the ribbon slab 381 (along with sheet piling 382, 384). The sidewalls 387, 388 are preferably reinforced cast-in-place concrete or shotcrete. The wall members 387, 388 can also be post-tensioned, in which case tensioning buttresses can be cast periodically (e.g., every 90 degrees if the subterranean wall is radial) inward into the chamber 383. The wall members 387, 388 can also be precast concrete panels which are bolted, grouted or welded via inserts to the concrete slab 381.

Figure 9:
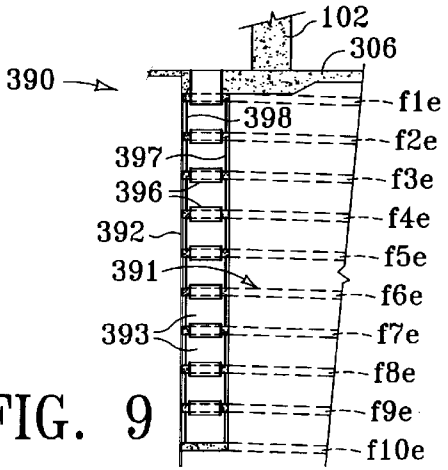

Turning to FIG. 9, a structure 390 includes a spiral ribbon slab 391 having flights f1*e* through f10*e*. The outer perimeters of the flights f1*e*–f10*e* are joined together by outer sheet piling 392, while the inner perimeters of the flights are joined together by wall member 397 (i.e., there is no sheet piling at the inner perimeter of the flights f1*e*–f10 *e*. Otherwise, the structure 390 of FIG. 9 is similar to the structure 380 of FIG. 8 in that the caisson liners 396 of the structure 390 do not extend continuously from flight f1*e* to f10*e*, thus leaving tunnel voids 393. Structure 390 further includes an outer wall member 398 which is attached to the outer sheet piling 392, and faces the inner periphery of the ribbon slab 391 (i.e., wall 398 faces wall 397). As evidenced by FIG. 9, it will be appreciated that the use of sheet piling (e.g., sheet piling 382 and 384 of FIG. 8) is not a requirement of the methods and apparatus of the present invention, since ground conditions can be such that sheet piling is not required to maintain the excavation for the ribbon slab 391 (FIG. 9), especially within competent fills or rock. However, there does need to be an adequate means of supporting the evolving ribbon slab 391 so that it remains structurally sound and the structure 390 as a whole does not undergo undo settlement during construction. This is particularly important where the secondary structure 102 which will be supported on the foundation 390 is being simultaneously constructed with the foundation 390. It will also be appreciated that sheet piling is typically a temporary means of earth and/or ribbon slab support within what can be called the "active zone" where the excavation for the subterranean wall is progressing, but the casting of slab 391 and secondary support walls 397, 398 of void space 393 fill to support the ribbon slab 391 lags behind the excavation face by a certain finite distance, all of which will be described more fully below. Secondary support walls 397, 398 are preferably reinforced cast-in-place concrete or shotcrete. The wall members 397, 398 can also be post-tensioned, in which case tensioning buttresses can be cast periodically (e.g., every 90 degrees if the subterranean wall is radial) inward into the chamber 393. The wall members 397, 398 can also be precast concrete or steel panels which are bolted, grouted or welded via inserts to the concrete slab 391.

Another reason to not use sheet piling is that the profile (defined by wall members 397 and 398) of the structure 390 of FIG. 9 can represent the simultaneous construction of a subterranean wall and the excavation of the interior soil (e.g., soil S1' of FIG. 3) so that a tank can be constructed within the confines of the subterranean wall 390. In this method of construction, outer sheet piling 392 is used to contain the soil outside of the subterranean structure 390 and to reduce the inflow of groundwater into the area within the structure, but no inner sheet piling on the inside face (by wall 397) is required because the excavation is accomplished with an "open side" type approach wherein the ribbon slab 391 on the inside is temporarily supported with screw-jacks within the "active zone" until such time as support wall 397 has caught up to the jacks and they are moved forward and downward (recall that the slab is continuously descending) following the excavation of the face of the spiraling tunnel. In this way, embedment for a water tight steel membrane or moisture barrier (for example, as used in LNG tanks) can be embedded in the inside edge of the ribbon slab 391 as well as within the support wall 397, 398 being cast between spiral intervals of ribbon slab.

Figure 13:
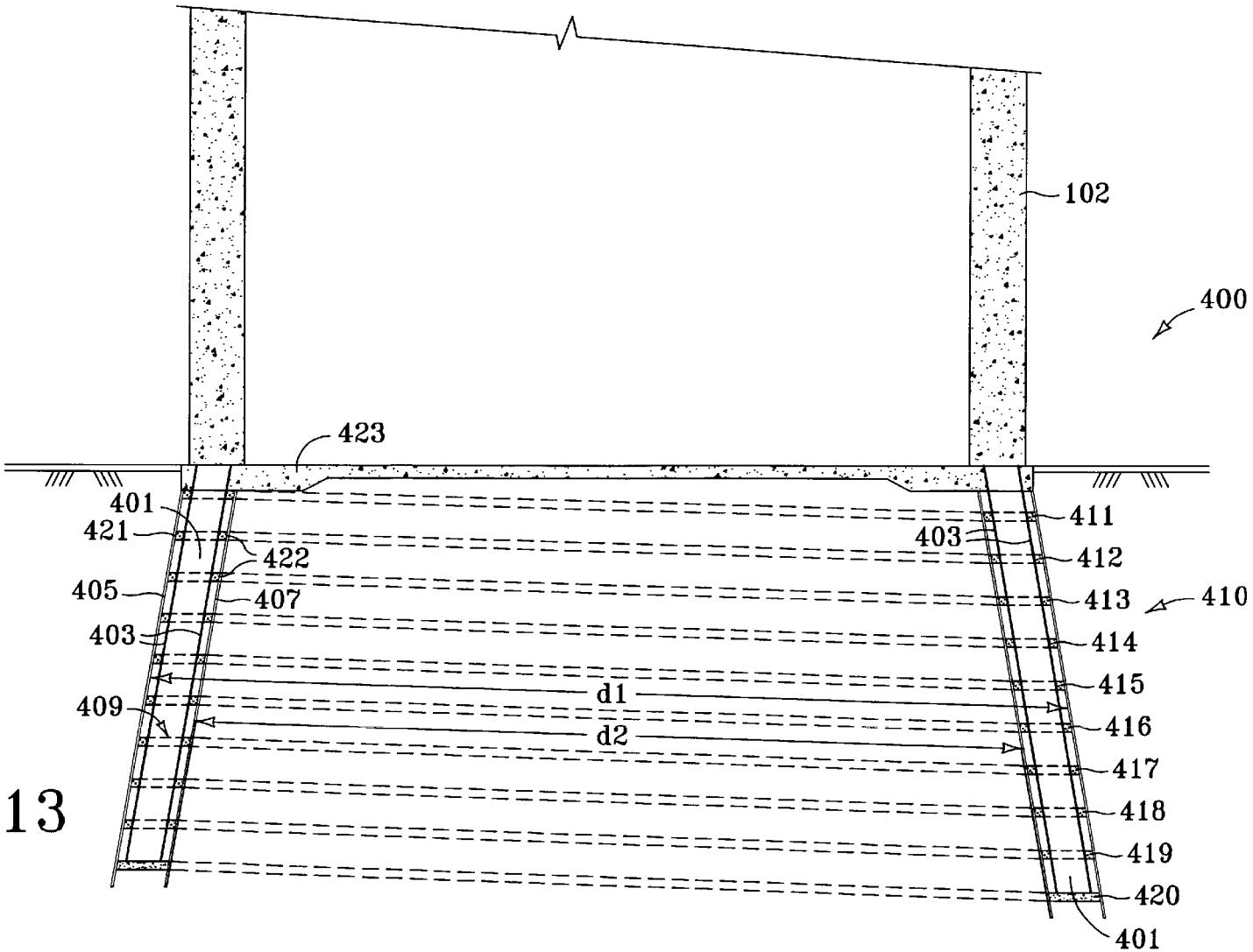
FIG. 13 is a side elevation sectional view depicting another subterranean structure in accordance with an embodiment of the present invention.

Turning briefly to FIG. 13, a side elevation sectional view (similar to the view of FIG. 3) depicts a subterranean structure 410 which supports a secondary structure 102. Secondary structure 102 can be a building, for example. The foundation 410 includes a continuous ribbon slab 409 which is made up of flights 411 through 420, and is preferably fabricated from cast, reinforced concrete. Caisson liners 403 are placed in periodic openings in the flights 411420 to form caissons 401. It will be noted that in FIG. 13 the secondary structure 102 is placed directly on top of the caissons 401, rather than being offset as in FIG. 3. A foundation cap 423 can provide additional support for the secondary structure 102, but is not essential for all applications to support of structure 102. The outer perimeters 421 of flights 411–420 are joined to one another by outer sheet piling 405, while the inner perimeters 422 of flights 411–420 are joined to one another by inner sheet piling 407. The ribbon slab 409 is defined by an outside diameter "d1", and an inside diameter "d2". As can be seen, the outside diameter d1 of each subjacent flight is larger than the outside diameter of an immediately-above flight. For example, the outside diameter of flight 415 is larger than the diameter of the immediately-above flight 414. This configuration helps the structure 410 to achieve many of the structural benefits accorded by structures 300 and 340 depicted in FIGS. 4 and 6. FIG. 13 also depicts a structure 400 which includes a building 102, and a foundation 410 which supports the building 102.

While FIGS. 4–6 and 13 all depict means of increasing effective out-of-plane rigidity of the respective structures 300, 320, 340 and 400 as a function of the depth of the structure below grade, in some applications it can be useful to decrease the effective out-of-plane rigidity of the structure as a function of depth, or to maintain a constant out-of-plane rigidity of the structure (such as structures 100 and 200 of FIG. 3). Other times it can be useful to vary the out-of-plane rigidity of the structure as a function of depth. For example, in a mining application where the structure passes through broken rock and then hard rock, in this instance the out-of-plane rigidity of the structure can be increased through the broken rock and then decreased into the hard rock, and then gradually increased again with depth. Further, the width ("W", FIG. 1) of the slab, and/or the thickness "T" of the slab, as well as the slab interval "H", can be varied as a function of depth for tied caisson foundations where the lateral rigidity can be reduced through more competent soils, and then increased again at the bottom of the foundation where a large end bearing component of the caissons can be achieved with a spreading and thickening of the ribbon slab. By "competent soils" we mean soils that are more structurally sound than adjacent soils, in that the "competent soils" are less likely to shift under loads, and in particular lateral loads, than the adjacent less-competent soils.

Moreover, the width, thickness, inside diameter and/or slab interval of the continuous slab can be varied depending on the application of the structure, and not just as a function of surrounding soil types. For example, if the structure is to be used to form a subterranean isolation barrier for contaminated soil, and the area of the contamination decreases as a function of depth, then the inside diameter of the slab (and other dimensions of the slab) can be decreased with depth.

Figure 10:
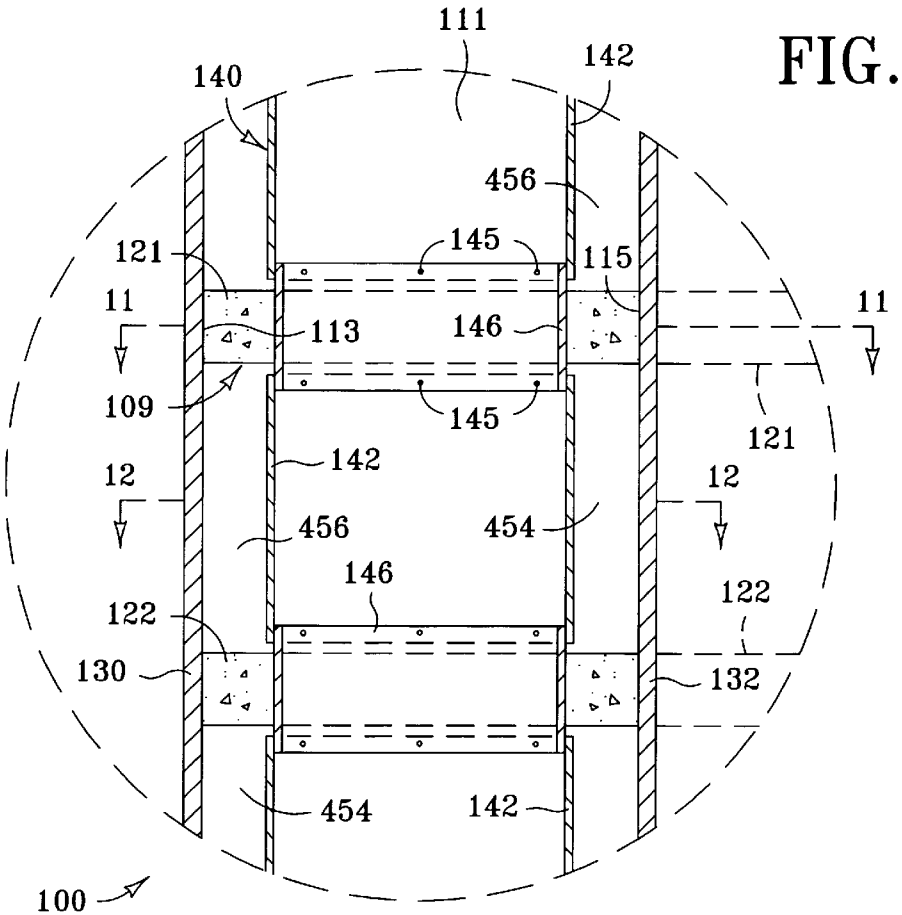
FIG. 10 is a side elevation sectional detail depicting a caisson and caisson liner of one of the subterranean structures depicted in FIGS. 2 and 3, in accordance with an embodiment of the present invention.

Turning now to FIG. 10, a side elevation sectional detail from FIG. 3 is shown. FIG. 10 depicts details of the caisson liner 140. The view depicted in FIG. 10 shows the second and third flights 121 and 122 of the ribbon slab 109, the outer sheet piling 130 at the outer periphery 113 of the ribbon slab, and the inner sheet piling 132 at the inner periphery 115 of the ribbon slab. As can be seen, each flight 121, 122 of the ribbon slab 109 defines an opening therein (not numbered), and the openings are generally aligned. A two-part cylindrical caisson liner 140 is received within the openings defined in the flights 121, 122, to thereby define a caisson 111 which passes through the tunnel areas 456 defined between the sheet piling 130, 132 and adjacent flights 121, 122. When in place, the caisson liner 140, along with sheet piling 130, 132 and flights 121, 122, define a void area 454 external to the caisson 111. As will be described further below, this void area 454 can be filled with a fill material (such as concrete, shotcrete, rock, dirt, sand, etc.) as the ribbon slab 109 is being constructed to support adjacent flights of the slab 109. During construction, the caisson liners 140 can provide access from lower flights to upper flights, and to the top of the structure itself (see for example FIG. 3). Following construction, the caissons 111 can also be filled with a fill material, or they can be left open. One instance in which the caissons can be left open is so that the foundation 100 can be periodically inspected.

Figure 11:
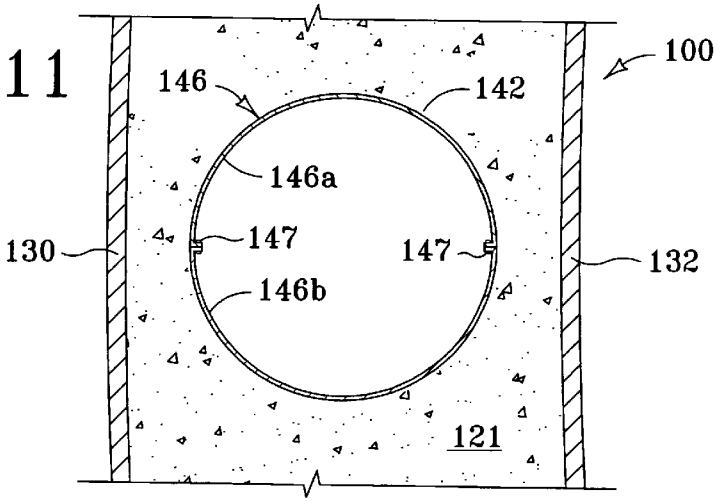
FIGS. 11 and 12 are plan sectional views depicting the caisson and caisson liner depicted in FIG. 10.
Figure 12:
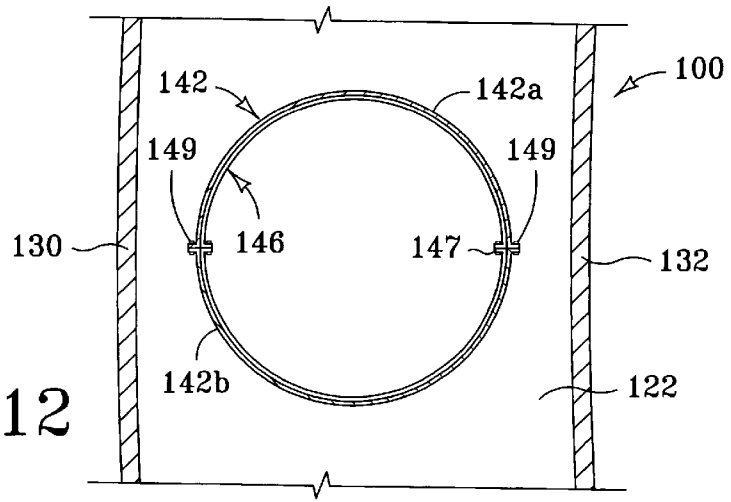

The two parts of the caisson liner 140 include a first part 146 which is received within the opening defined in the flights 121, 122. This first part 146 corresponds to the partial caisson liners 366, 386 and 396 of respective FIGS. 7, 8 and 9. During construction, the ribbon slab 109 can be cast about the liner first part 146 merely by placing the liner part on the ground in front of the evolving slab 109, and then pouring the next portion of the slab around the liner part. Turning briefly to FIG. 11, a plan sectional view through the flight 121 and the caisson liner first part 146 is depicted. The liner first part 146 can itself be a two-part component, having first and second halves 146*a* and 146*b*, which can be connected together by bolts or pins 147. In this way the liner first part 146 can be passed down through the caisson liner 140 as it evolves downward with construction of the ribbon slab 109. Turning back to FIG. 10, the caisson liner 140 includes a liner second part 142 which overlaps an upper and lower edge of the adjacent liner first parts 146 to thereby allow the caisson 111 to span between adjacent flights 121, 122 of the ribbon slab 109. The liner second part 142 can be attached to the liner first part 146 by screws 145, bolts, pins or welding. Turning briefly to FIG. 12, a plan sectional view through the caisson liner second part 142 between flights 121 and 122 is depicted. The liner second part 142 can be a two-part component, having first and second halves 142*a* and 142*b*, which can be connected together by bolts or pins 149. In this way the liner second part 142 can be easily installed around the ends of the liner first part 146, as depicted in FIG. 10. It will be appreciated that liner parts 142 and 146 can also be made from more than two parts, for example they can each be in three parts rather than in halves.

We will now describe a method of constructing a subterranean structure in accordance with one embodiment of the present invention. Generally, this method includes excavating soil to form a downward sloping ramp, and then forming a concrete slab on the downward sloping ramp. Soil is continued to be excavated to extend the downward sloping ramp to a location under the concrete slab. For example, the ramp can be circular in plan view (see FIG. 2, for example) to allow the extending ramp to pass under the previously-formed portion of the evolving concrete slab. The concrete slab is continued to be formed on the downward sloping ramp so that a subterranean structure is formed having an essentially continuous concrete slab. The continuous concrete slab will have a first portion (such as flight 120 of FIG. 3) which is above and spaced-apart from a second portion (such as flight 121 of FIG. 3). Preferably, the second portion of the concrete slab is generally in alignment with the first portion. FIGS. 5–9 and 13 all depict structures where the flights can be considered generally in alignment, notwithstanding that some of the flights widen as they descend. The method can further include joining the first and second portions of the slab at their inner and/or outer peripheries with wall members, as shown for example in FIG. 8 where first wall member 387 joins flights f1*d*–f10*d* at the inner peripheries of the flights, and second wall member 388 flights f1*d*–f10*d* at the outer peripheries of the flights.

Figure 14:
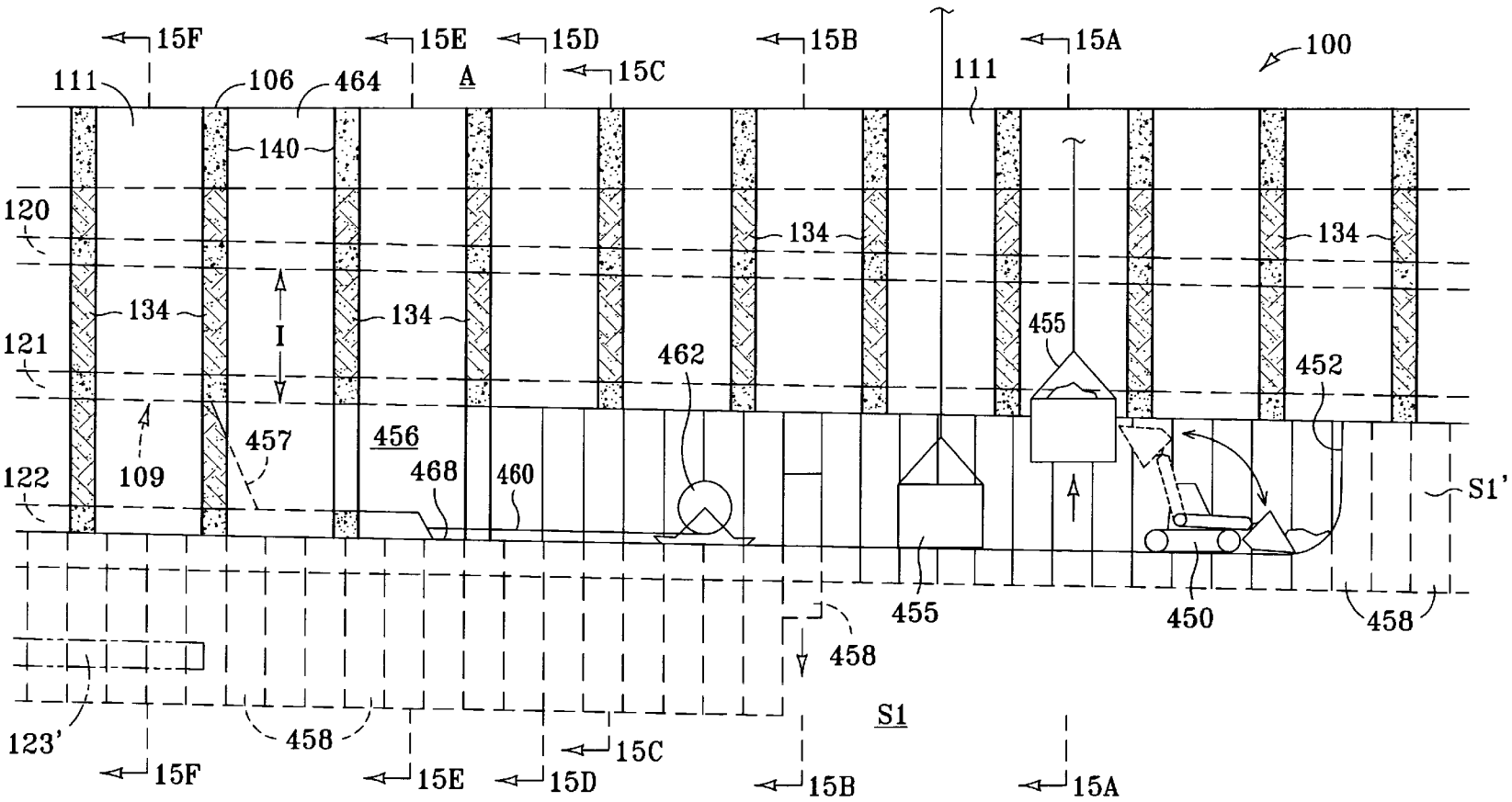
FIG. 14 is a "fold-flat" partial side elevation sectional view depicting a method of constructing one of the subterranean structures of FIG. 3 in accordance with an embodiment of the present invention.

Turning now to FIG. 14, a side elevation sectional view depicts a method of forming a subterranean structure in accordance with an embodiment of the present invention. The view depicted in FIG. 14 is a "fold-flat" partial section taken from FIG. 2. By "fold-flat" we mean that the view has been adjusted to remove the effects of curvature which would be present in a true sectional view as taken from FIG. 2. FIG. 14 depicts a portion of the foundation 100 (of FIGS. 2 and 3) beneath the foundation cap 106. As indicated, the view portrays flights 120 and 121 of the continuous spiral slab 109 as having already been formed, and the third flight 122 as being only partially formed, and in the process of continuing to be formed. The third flight 122 is supported on the surface 468 of the ground or soil S1 at this point in the forming process. A tunnel 456 is formed by the partially formed slab 122, the ground S1, the immediately-above flight 121, and the sides defined by sheet piling 458. Openings 464 in the foundation cap, and caisson liners 140 which pass through aligned openings in the flights 120 and 121 (in the manner depicted in FIG. 10), allow access from the surface "A" to the tunnel area 456. The caisson liners 140 define caissons 111. The area between the work-face 452 (where soil S1' is being excavated by excavator 450) and the fill-face 457 (where fill material is being placed in the tunnel 456) define the "active-zone" (or "work-zone"). Flight 121 can be sufficiently strong to be self-supporting in the active zone, but it can also be temporarily supported in the active zone by jacks, shoring, sheet piling, timbers, or other known means common to mining practices. Although not particularly evident in FIG. 14, the excavation at the work-face 452 advances the tunnel 456 not only inward (i.e., rightward as viewed in FIG. 14), but also slightly downward so that a continually downward spiral slab 109 is formed (as in FIG. 1). Excavated soil is placed in one or more buckets 455 which can then be raised to the surface "A" by a crane or a winch or the like. Although the excavation is depicted as being performed by an overshot excavator 450, other means of excavating can be used, depending on the nature of soil S1', the available space in the tunnel 456, local availability of equipment and labor, and other factors. For example, the excavation can be performed using water-jetting to erode the work-face 452, and the soil-water slurry can then be recovered by a pump and pumped to the surface "A" via hoses or pipes which are located in the caissons 111. The excavator 450 can also be a slewable excavator, an overshot excavator, or a tunnel boring apparatus such as are commonly used in the mining industry, and particularly for underground coal mining.

As is depicted in FIG. 14, as the tunnel 456 is being advanced into soil S1', sheet piling 458 is driven into soil S1 down to a location slightly below the area where the next flight will be formed (indicated by phantom lines as 123'). Similarly, the sheet piling 458 in the work-zone will have been put in place as flight 121 was formed, thus providing for a relatively solid wall in the work-zone to thus reduce cave-ins and groundwater intrusion into the work zone. As can be seen, the surface 468 on which the excavator 450 is supported is slightly above the bottom of the sheet piling 458 in the area where the work face 452 is being excavated. The reason for driving the sheet piling 458 below the level where the next-to-be installed flight will be located is to provide that as the excavation progresses, the bottom of the sheet piling stays in a competent footing with soil S1 and is not undermined. This distance below the next-to-be installed flight which the sheet piling 458 is installed is preferably about one-third or greater of the spiral interval "I".

As the excavation progresses, the buckets 455 (and/or slurry pipes, not shown) are moved to the next succeeding caisson chambers 111 to facilitate the construction activities within the advancing "active zone". Immediately behind the excavating activity at the workface 452 the sheet piling 458 for the next level 123' is being installed. Preferably, spliced sheets are used for the sheet piling 458 since the ceiling height "I" does not allow a single length sheet to reach the required depth as just described. Also, it is preferable to use a machine to perform installation of the sheet piling 458 (versus using hand pile-driving equipment) since there is better geometric control with a machine (i.e., the advancing spiral path of the flights of the slab 109 can be better controlled). Immediately behind the sheet piling activity is where spools 462 for post tensioning ducts and/or tendons 460 are located (as described more fully below).

FIG. 14 shows section lines for FIGS. 15A through 15F, which depict the various activities within the active zone (other than the excavation which occurs at the workface 452). FIGS. 15A–15F all show the same common following items: a portion of the foundation cap 106, the soil S1 outside of the foundation 100 (FIG. 3), the soil S1' inside the foundation 100 (FIG. 3), the caisson liner 140, the caisson 111 defined by the caisson liner, the first flight 120 and second flight 121 of the spiral slab 109 (FIG. 3), outer sheet piling 130, inner sheet piling 132, and fill material 134 placed between the inner and outer sheet piling. It should be noted that only those features which appear in the plane of the section in FIGS. 15A–15F are depicted in the figures to facilitate understanding of the process being depicted.

Figure 15C:
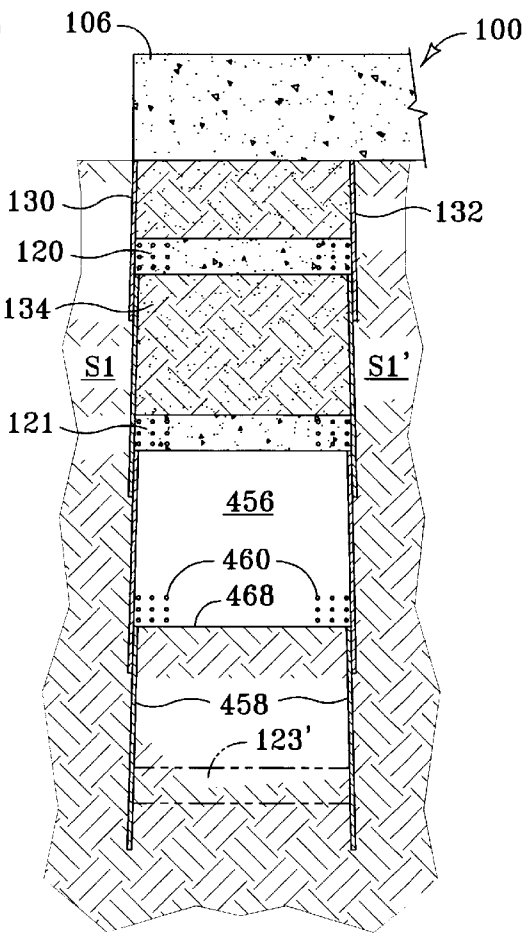
FIGS. 15A through 15F are sectional end views of the method depicted in FIG. 14, depicting various stages of constructing the subterranean structure.
Figure 15B:
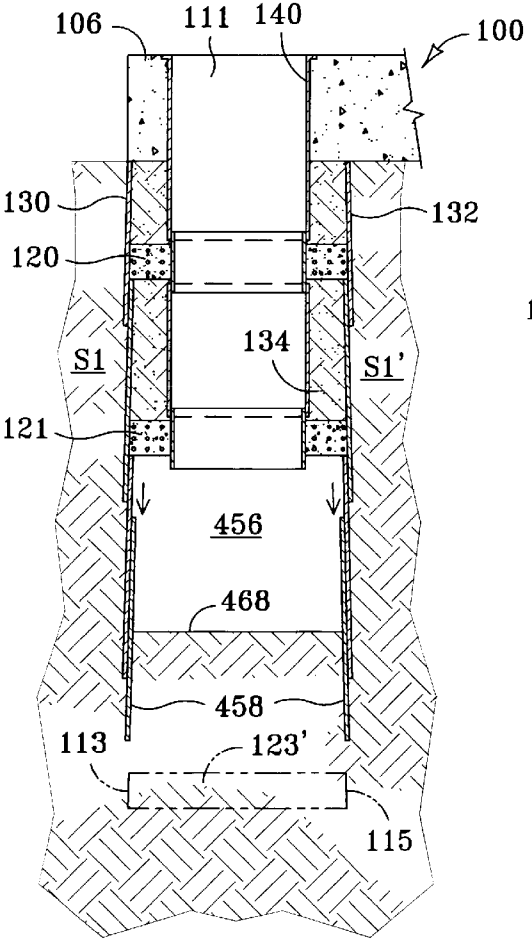
Figure 15A:
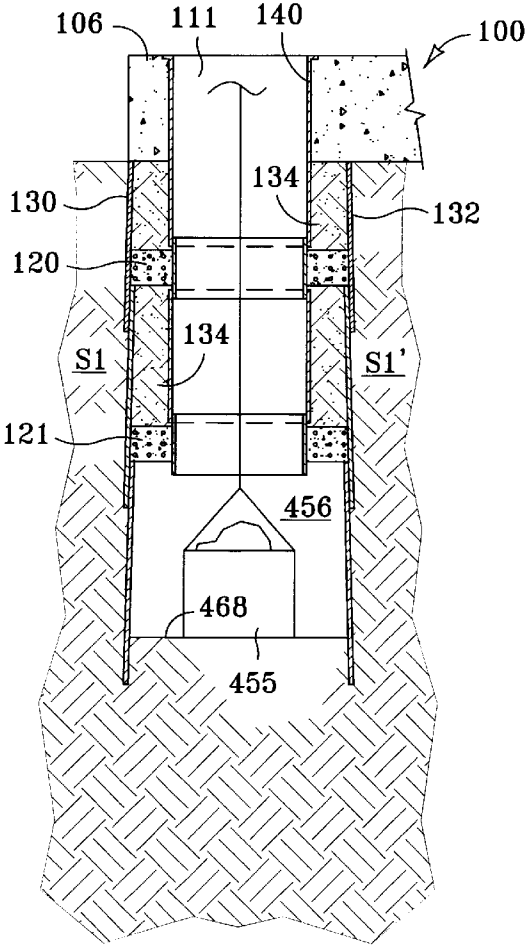
Figure 15F:
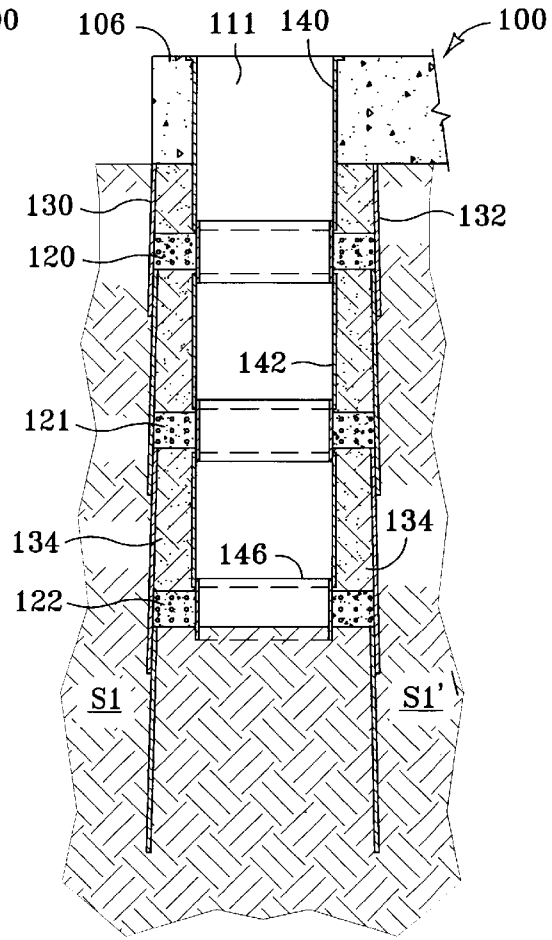
Figure 15E:
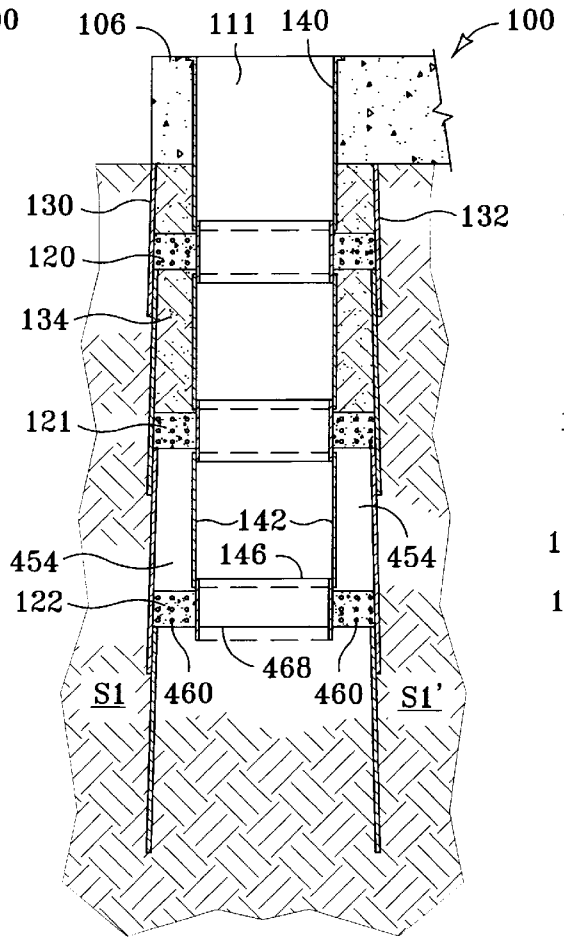
Figure 15D:
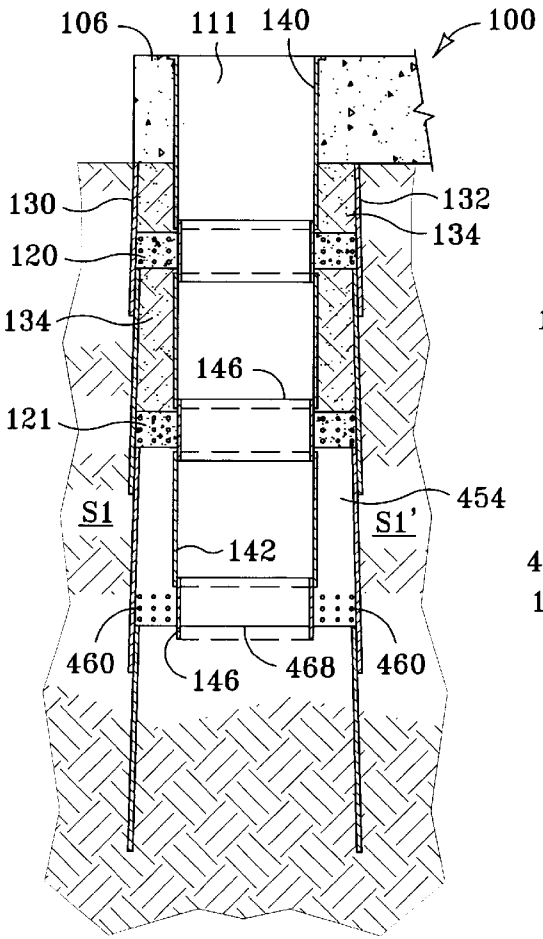

Turning now to FIG. 15A, the excavation bucket 455 is located in the tunnel area 456, and work in the active zone takes place on the slab grade 468 (i.e., the ground surface grade on which the future slab 122 will be installed). FIG. 15B depicts the area where sheet piling 458 is being installed down to the next level where flight 123 will be installed (indicated by dashed lines 123'). The sheet piling 458 facilitates in aligning the outer and inner perimeters 113 and 115 (respectively) where the next flight 123' will be located, in the same manner that sheet piling 130 and 132 generally vertically aligns flight 121 with flight 120. In FIG. 15C the sheet piling 458 for the level flight 123' has been fully installed, and post-tensioning cables or ducts 460 are in place. At this time, a caisson liner first part (146, FIG. 10) can be placed on the grade slab 468 between the post-tensioning cables 460 so that when the slab is poured the caisson liner first part will be cast into the slab, thereby forming a hole or opening in the slab. FIG. 15D depicts the next level of the caisson liner 140 as being completely installed. As described previously, liner first part 146 can be supported on the grade slab 468, and caisson liner second part 142 can be installed around the previous liner first part in slab 121, and the liner first part 146 which is resting on the grade slab 468. The manner in which the liner second part 142 can be installed was previously described with respect to FIG. 12. In FIG. 15E the next portion of spiral slab flight 122 has been poured or cast on grade slab 468, and has been formed around the post-tensioning tendons 460 and the caisson liner first part 146. Finally, in FIG. 15F the remaining tunnel area (454, FIG. 15E) at the sides of the caisson liner 140, and the area behind the caisson liner (not visible in FIG. 15F) is filled with a fill material 134. As the excavation at the workface 452 of FIG. 14 advances, the process depicted in FIGS. 15A–15F is repeated. This is done until the whole ribbon slab (109, FIG. 3) has been formed.

It will be appreciated that other variations described herein can also be included with the method depicted in FIGS. 15A–15F. For example, wall members (e.g., 387, 388, FIG. 8) can be installed in lieu of, or in addition to, sheet piling 458 and/or fill material 134. Further, after the ribbon slab 109 (FIG. 3) has been fully formed, the caissons 111 can be filled with a fill material. In embodiments where the structure 100 is a foundation, a typical fill material for the caissons 111 is reinforced concrete. In other embodiments the slab 109 does not need to be continuously downward sloping, but can be incrementally stepped-down (as described more fully below). In yet another embodiment a plurality of interleaved slabs can be simultaneously formed (as also described more fully below). Thus, it is appropriate to describe the evolving structure as having a "first portion" and a "second portion" of a "slab", in which the first portion and the second portion are generally vertically aligned. For example, in FIG. 15A flight 120 can be considered the "first portion" and flight 121 can be considered the "second portion".

Returning briefly to FIG. 3, it will be appreciated that the subterranean structure 100 is a foundation having soil S1' on the inside of the structure 100 (thus making the structure a "mono-caisson" to support the building structure 102), and being surrounded by soil S1 on the outside of the structure. In another embodiment of the present invention, in a structure similar to the structure 100 of FIG. 3, the soil around the outside of the structure (equivalent to soil S1 of FIG. 3) can be excavated to produce an earthen column constrained by the structure 100. In yet another embodiment, in a structure similar to the structure 100 of FIG. 3, the soil inside of the structure (equivalent to soil S1' of FIG. 3) can be excavated to produce a storage area, such as a tank, vessel or bin. In this latter embodiment a roof or a top can be placed over the open inner area to complete the storage container, as will be described more fully below. In a further embodiment, in a structure similar to the structure 100 of FIG. 3, both the soil outside the structure (equivalent to soil S1 of FIG. 3), as well as the soil inside of the structure (equivalent to soil S1' of FIG. 3), can be excavated after (or as) the structure is formed to leave a remaining free standing structure, such as a self supporting wall.

Figure 17:
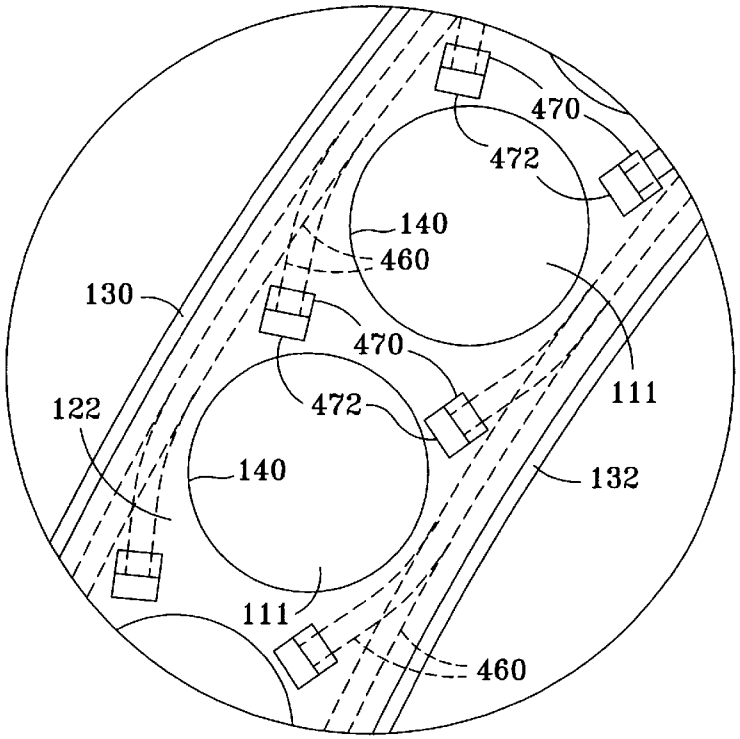
FIGS. 16 and 17 are detail plan views depicting how a concrete slab constructed in accordance with a method of the present invention can be post-tensioned.
Figure 16:
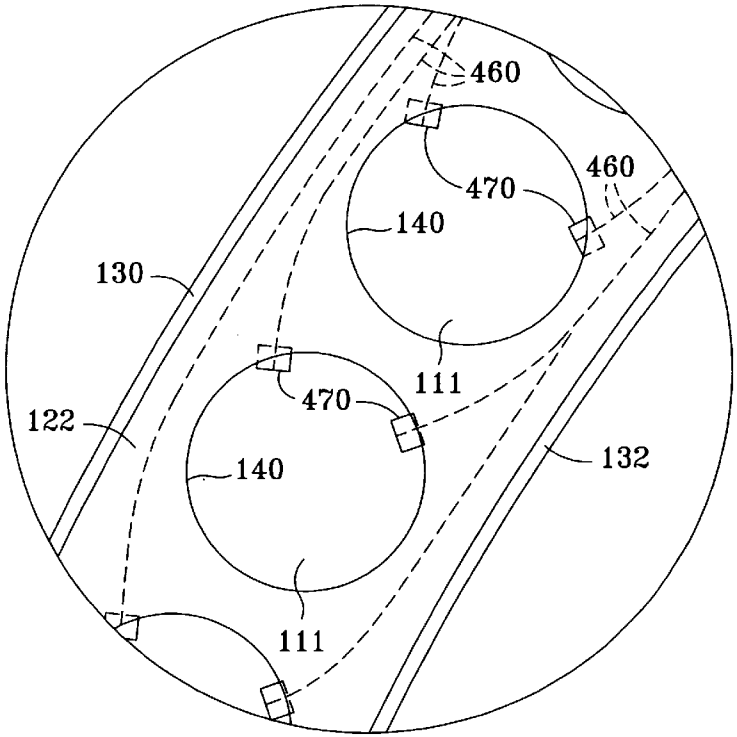

FIG. 16 is a plan view depicting how post-tensioning tendons 460 can be anchored in exemplary flight 122 (see FIGS. 15D and 15E) of an evolving continuous concrete slab of the present invention. FIGS. 16 shows a short portion of the slab flight 122, including the outer sheet piling 130, the inner sheet piling 132, and caisson liners 140 which define the periodic caissons 111. In this example the tendon anchors 470 are set in the liner first part (similar to liner first part 146 of FIG. 11). This is advantageous since it allows the anchors 470 to be provided as adjustable tensioning sites, and the tendons 460 can thus be tensioned by entering the caissons 111. This allows tension in the tendons 460 to be adjusted several times at all flights of the continuous slab as the entire slab is being formed. A less preferred embodiment for anchoring the post-tensioning tendons is depicted in FIG. 17, which is similar to FIG. 16 in that it is a plan view depicting a section of flight 122, including sheet piling 130 and 132, caisson liners 140, and caissons 111. In FIG. 17 the anchors 470 are set in block-outs 472 (i.e., open areas) in flight 122. As can be seen in FIG. 15A, when fill material 134 is provided around the caisson liners 140, then post-tensioning anchors set in the flights themselves (as in FIG. 17) are generally not later accessible once the next-lower flight (in FIG. 15A, flight 121) is fully formed. It will be appreciated that FIGS. 16 and 17 only depict initiating anchors for post-tensioning tendons, and that similar terminating post-tensioning anchors can similarly be provided, which essentially mirror the initiating anchors along a line perpendicular to the centerline of the flight 122.

Figure 18:
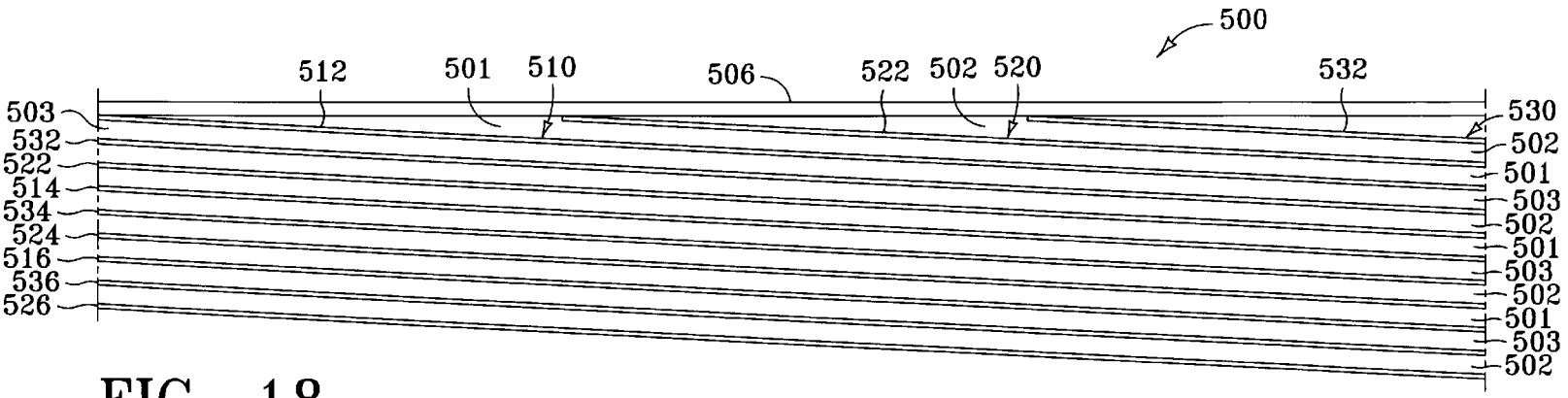
FIGS. 18 and 19 are "fold-flat" side elevation sectional views depicting other subterranean structures in accordance with embodiments of the present invention.

Turning now to FIG. 18 a simplified side elevation, sectional diagram depicts a subterranean structure 500 in accordance with another embodiment of the present invention. The structure 500 includes a foundation cap 506 and three interleaved continuous ribbon slabs 510, 520 and 530, which are preferably fabricated from concrete. FIG. 18 is similar to FIG. 3 except that in FIG. 18 the slabs are fully visible, and no caissons or sheet pilings are depicted. Further, the view of FIG. 18 is a "fold-flat" section of the entire subterranean structure 500, depicting all 360 degrees of the circular structure (i.e., circular when viewed in a plan view). As described before, the structure 500 can be other shapes in plan view as well (such as rectangular, oval, elliptical, square, polygonal, etc.). Slab 510 includes consecutive, descending flights 512 through 516, slab 520 includes consecutive, descending flights 522 through 526, and slab 530 includes consecutive, descending flights 532 through 536. As can be seen, slabs 510 and 520 define a first continuous tunnel 501, slabs 520 and 530 define a second continuous tunnel 502, and slabs 530 and 510 define a third continuous tunnel 503. Generally, the slabs 510, 520 and 530 of FIG. 18 are set on a greater pitch (i.e., slope) than for example slab 109 of FIG. 3. The arrangement of interleaved slabs 510, 520 and 530 allow construction to be performed on all three slabs simultaneously. Caissons (not shown) can be formed in each of the slabs so that construction can be performed in a manner to that depicted in FIG. 14 and FIGS. 15A–15F. While FIG. 18 depicts a structure 500 having three interleaved slabs 510, 520 and 530, it will be appreciated that a similar structure can be formed using only two interleaved slabs, or using more than three interleaved slabs.

Figure 19:
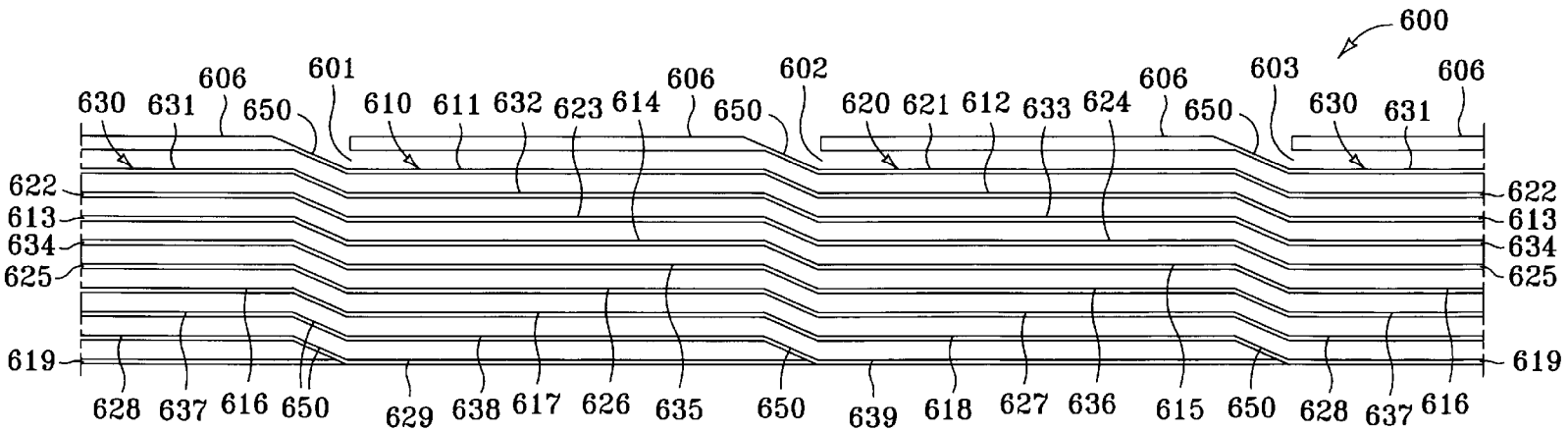

FIG. 19 is a side elevation view depicting a structure 600 in accordance with yet another embodiment of the present invention. Structure 600 includes a foundation cap 606 and three, interleaved slabs 610, 620 and 630. The view shown in FIG. 19 is similar to the view shown in FIG. 18, in that all of the slabs are fully shown and other details (sheet piling, caisson liners, caissons, etc.) have been eliminated from the view for the sake of simplicity and facilitating understanding of the salient details. Further, the view of FIG. 19 is a "fold-flat" section of the entire subterranean structure 600, depicting all 360 degrees of the circular structure (i.e., circular when viewed in a plan view). As described before, the structure 600 can be other shapes in plan view as well (such as rectangular, oval, elliptical, square, polygonal, etc.). Unlike structure 500 of FIG. 18 where the three slabs 510, 520 and 530 are all continually downward sloping slabs, the slabs 610, 620 and 630 of the structure 600 of FIG. 19 are generally horizontal, with periodic downward transition points 650 every 120 degrees. Slab 610 includes consecutive, descending sections 611 through 619, slab 620 includes consecutive, descending sections 621 through 629, and slab 630 includes consecutive, descending sections 631 through 639. It will be noted that we have used the expression "sections" rather than "flights", since certain of the sections within a given slab 610, 620, 630 do not overlap. For example, section 611 does not overlap sections 612 or 613, but it does overlap section 614. The slabs 610, 620 and 630 are spaced-apart so that they define three descending subterranean tunnels. For example, the sections of slabs 610 and 620 which overlap one another form tunnel 601, the sections of slabs 620 and 630 which overlap one another form tunnel 602, and the sections of slabs 630 and 610 which overlap one another form tunnel 603. Preferably, after the slabs 610, 620 and 630 have been constructed (or as they are being constructed), the tunnels 601, 602 and 603 are being backfilled with a fill material so that the levels are supported by one another and generally by the soil on which the structure 600 is being constructed. While FIG. 19 depicts a structure 600 having three interleaved slabs 610, 620 and 630, it will be appreciated that a similar structure can be formed using only two interleaved slabs, or using more than three interleaved slabs. Accordingly, the structure of FIG. 19 can be described as a structure having a plurality of adjoined (by joint ramps 650), spaced-apart concrete slabs (e.g., slabs 611 through 619) positioned in a subterranean excavation, (the excavation being performed as the slabs are being formed), and the concrete slabs (e.g., slabs 611–619) are preferably generally vertically aligned to thereby define a descending subterranean tunnel (e.g., tunnel 601). In this instance, the slabs 611–619 are generally aligned from side-to-side, but because of the periodic stepping-down at ramp joints 650 every 120 degrees, they are not aligned horizontally. However, if the ramping-down occurs only every 360 degrees, then the sections will be generally aligned horizontally as well. More preferably, the tunnel (e.g., tunnel 601) is at least partially filled with a fill material. Alternately, or in addition to fill material, wall elements (such as wall elements 387 and 388 of FIG. 8) can be formed in the tunnel.

Figure 20:
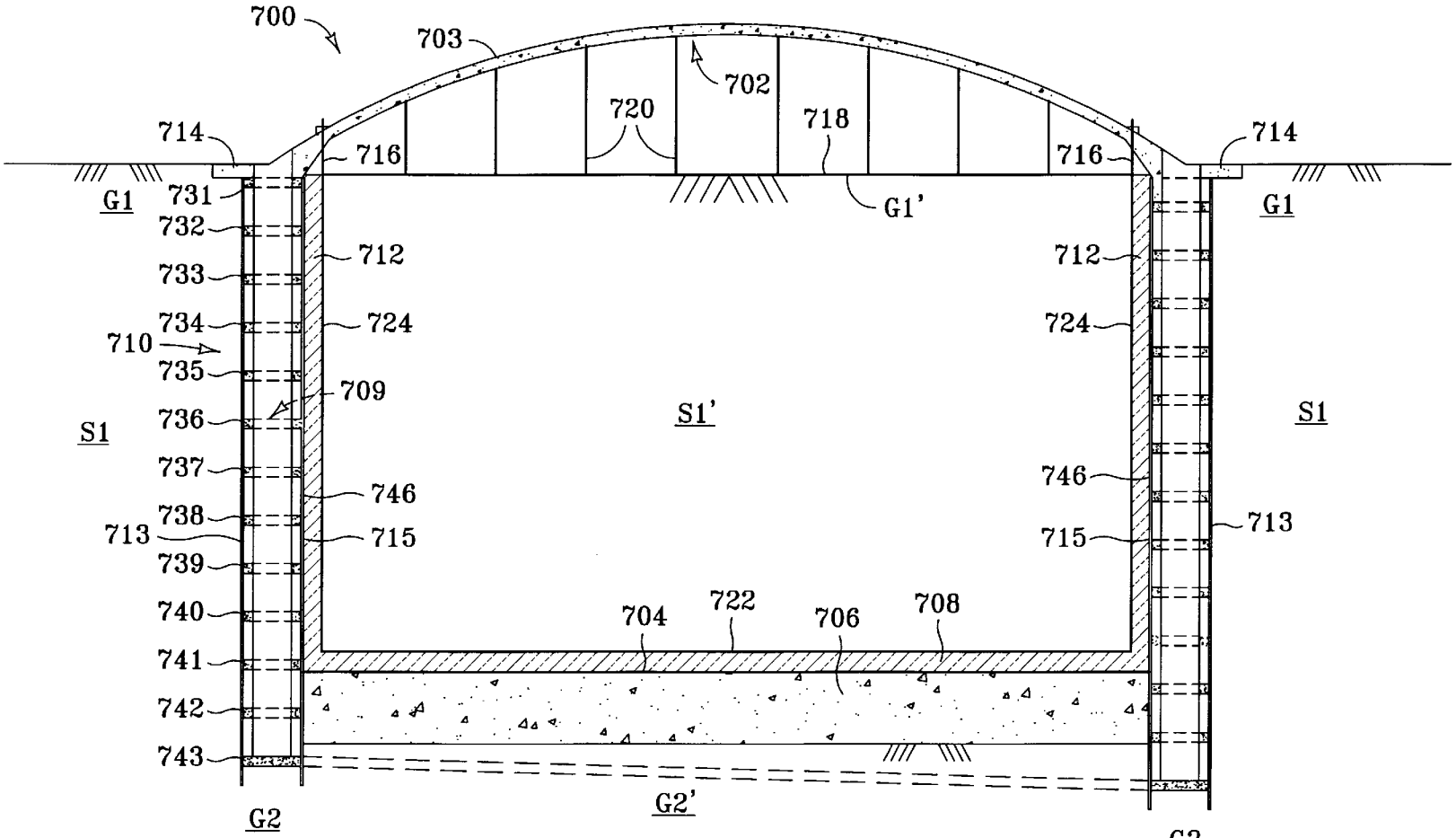
FIG. 20 is a side elevation sectional view depicting another subterranean structure in accordance with an embodiment of the present invention, wherein the structure is a vessel.

Turning now to FIG. 20, a side sectional view of another subterranean structure 700 in accordance with a further embodiment of the present invention is depicted. The structure 700 is a vessel generally having a top 702, a bottom 722, and a continuous closed wall 710 connecting the top and the bottom. The wall 710 includes a continuous ribbon slab 709 having a plurality of flights 731 through 743 fabricated from concrete and being defined by an inner perimeter 715 and an outer perimeter 713. The vessel 700 further includes wall panels 724 attached to the inner perimeter 715 of the ribbon slab 709 between the top 702 and the bottom 722.

The embodiment depicted in FIG. 20 makes use of the fact that the tank wall 710 and the roof 702 can be constructed simultaneously and that a watertight wall and structural wall can be constructed at the same time. A method for constructing the vessel 700 can be performed as follows. A tank lid 718, such as from nickel steel or the like, can be site fabricated on prepared ground surface G1'. The roof 702 (which can be fabricated from steel or the like) can then be constructed over the lid 718, and tension rods 720 can be attached between the lid 718 and the roof 702. A concrete portion 703 of the roof 702 roof can be cast having bearing flanges 714 to support the roof 702 on the soil G1. A foundation cap similar to cap 102 of FIG. 3 can also be provided to support the roof 702. Since the wall 710 can be fabricated simultaneously with fabrication of the roof 702, if the walls 710 are sufficiently developed when the roof 702 is placed, then the bearing flanges 714 can be eliminated. Preferably, simultaneously as the roof 702 is being constructed, the subterranean wall 710 can be constructed in accordance with methods described above with respect to FIGS. 3, 14 and 15A–15F. Excavation of the contained soils S1' can be begun as soon as the lid 718 is sufficiently supported. Note that the wall 710 does not necessarily have to be complete when excavation of the soils S1' begins. Excavation of soils S1' continues until grade G2'is established. The excavated material S1' can be removed with a hoist and bucket system, a high lift conveyor system, or using a hydraulic solids transport method with slurry pumps, or some combination of the these methods. Ballast weight 706, which can be concrete and/or a magnetite-cement mixture, can then be placed on the grade G2'. A moisture barrier liner 704, such as of carbon steel, can then be placed over the ballast 706. Thereafter leveling courses and bottom insulation 708 can be placed over the moisture barrier 704 along the bottom of the forming vessel 700, followed by the tank bottom 722, which can be fabricated from nickel steel plate or the like. Similarly, a moisture barrier 746 can be placed adjacent to the inner perimeter 715 of the wall 710, side insulation 712 can be placed over the side wall moisture barrier 746, and interior tank walls 724, which can be fabricated from nickel-steel, placed over the side insulation 712. Insulation (not shown) can be placed over the lid 718 in the area beneath the top 703. In one variation of the above method, the inner wall 724 can be constructed by hanging it from rods 716 around the perimeter of the roof 702 and constructing the inner tank wall 724 as the inside of the tank 700 is excavated from soil S1'.

While the structures 100, 200, 300, 320, 340, 360, 380, 390, 410, 500, 600 and 700 have all be described herein as "subterranean structures", it will be appreciated that the entire structure does not need to be located below the surrounding grade to be within the scope of the embodiments of the present invention. So long as at least two flights of a continuous concrete slab, which forms a part of the structure, are located below the surrounding grade, then the structure can be considered a "subterranean structure".

Furthermore, while embodiments of the present invention have described forming a subterranean structure to support a secondary structure (e.g., subterranean structure 100 of FIG. 3 supports secondary structure 102), it will be appreciated that similar methods and structures can be provided above grade to support a secondary structure. In this later embodiment the method of forming the support structure proceeds from the bottom up, rather than from the top down (as described with respect to FIGS. 14 and 15A–15F). In one example of this embodiment a spiral slab is constructed beginning with a first flight on a grade (or slightly below grade). Thereafter, a second flight is formed over the first flight, and the second flight is supported on a fill material placed over the first flight. Subsequent flights can be added by placing a fill material on the immediately subjacent flight, and then forming the next flight. Rather than using sheet piling (such as piling 130 and 132 of FIG. 3), a retaining wall can be formed between the flights to constrain the fill material being placed between the flights. In fact, the just-described above-grade structure can be incorporated similar to foundation 100 of FIG. 3, for example, so that an overall structure, having an above-grade section and a below-grade section, both constructed in accordance with embodiments of the present invention, can be constructed.

Another embodiment of the present invention provides for a method of subterranean mining. This method can be similar to the method depicted in FIGS. 14 and 15A–15F. In this embodiment, the soil excavated as the continuous slab proceeds downward into the earth can be processed to remove commercially valuable materials (such as metals, coal, etc.). With reference to FIG. 1, a subterranean structure in accordance with certain embodiments of the present invention includes a continuous concrete slab 10 which has a width "W" which is typically significantly smaller than the diameter "D" across the flights 12, 14, 16, 18 and 20. However, when methods of the present invention are used for subterranean mining, then typically the ratio of the width of the flight to the diameter of the flight will be much larger to increase soil extraction (and therefore mineral recovery), and reduce unclaimed soils. Further, using methods of the present invention for mining purposes allows tailings to be used for fill material between flights.

In yet another embodiment of the present invention methods and structures in accordance with other embodiments of the present invention can be used for open pit mining. In this embodiment a structure similar to retaining wall 200 of FIGS. 2 and 3 can be constructed (but without foundation 100 and secondary structure 102) to define the open pit and provide geo-stability of the walls defined by the forming pit. In one example, the retaining wall structure can be formed as the pit, defined within the retaining wall, is excavated to remove useful ores and other subsurface materials. Although retaining wall 200 of FIG. 3 is depicted as having an essentially vertical wall, in the case where a retaining wall constructed in accordance with embodiments of the resent invention is used to define an open pit mine, the wall can also taper inward as the depth of the wall increases. The use embodiments of the present invention for open pit mining can result in a single structure being used to define the open pit mine, such as a structure which is circular in plan view (similar to retaining wall 200 of FIG. 2), which results in a single, continuous wall (as viewed in the plan view). Alternately, a plurality of structures in accordance with embodiments of the present invention can be used to produce a plurality of walls which thus define the open pit mine.

Continuous concrete spiral slabs having generally vertically aligned flights or levels are well known structures. One common example is to use a continuous concrete spiral slab to provide access to various levels of a parking garage. While such prior art structures are commonly located above ground, they have also been used below ground for access purposes. Such prior art structures are used to support a localized load on the slab itself, as for example the load imposed by a vehicle using the slab to access a level of a parking garage. Such prior art continuous slabs have not been used to support a secondary structure. Accordingly, prior art continuous slabs are designed and constructed for localized loads. That is, prior art continuous slabs are not designed or configured to support a generalized load placed over the uppermost flight or level of such a structure. One significant feature of certain structures in accordance with the present invention is providing a fill material, and/or supporting wall elements, between levels or flights of an essentially continuous concrete slab (wherein the levels or flights are generally vertically aligned) to provide support between the levels or flights themselves. Furthermore, prior art continuous slabs have not been used to form a monocaisson (such as structure 100 of FIG. 3) to contain soil (such as soil S1' of FIG. 3), or to define the wall of a storage vessel (such as vessel 700 of FIG. 20).

While examples described herein have been depicted as using a single subterranean structure (such as foundation 100 of FIG. 3) to support a single secondary structure (e.g., secondary structure 102 of FIG. 3), it will be appreciated that multiple subterranean structures in accordance with embodiments of the present invention can be used to support a single secondary structure. For example, two or more foundation structures similar to structure 100 of FIG. 3 can be used to support a single secondary structure. In this example, a monolithic foundation cap (similar to foundation cap 106 of FIG. 3) can be used to support the secondary structure on the multiple subterranean foundation structures. Further, a single subterranean structure (such as structure 100 of FIG. 3) can be used to support multiple secondary structures. In this latter example a single foundation cap placed over the single subterranean structure can support the multiple secondary structures on the single subterranean foundation structure. While the secondary structure (102, FIGS. 2–9) has been described as being a building, it can also be a movable piece of equipment, or any other structure or device which can be supported on a foundation.

Thus far we have described examples of a subterranean structure which have a closed form in plan view, and which define an inner volumetric area (e.g., spiral slab 10 of FIG. 1 defines an inner volumetric area of diameter "D" having a height between the uppermost flight 12 and the lowermost flight 20). By "closed form" we mean that, in a plan view, if one begins at a first point and follows a continuous forward-progressing line along the form, one will eventually arrive again at the first point. However, the present invention also provides for a subterranean structure which can be in an open form. By "open form" we mean that, in a plan view, if one begins at a first point and follows a continuous forward-progressing line along the form, one will not again arrive at the first point. In simple terms, a "closed form" does not have endpoints, whereas an "open form" has two or more endpoints. Examples of a "close form" include a circle, an ellipse, an oval, and a polygon. An example of an "open form" is a line (straight or curvilinear). Accordingly, the present invention provides for forming a subterranean open-form structure (such as a retaining wall) using methods disclosed herein, which includes a continuously downward-progressing concrete slab. For example, if the structure is a retaining wall having endpoints "A" and "B", then the structure includes multiple levels or flights having switchbacks located essentially at the endpoints (as viewed in a plan view).

While the above invention has been described in language more or less specific as to structural and methodical features, it is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A subterranean vessel, comprising:

a top and a bottom; and a continuous closed wall connecting the top and the bottom, the wall comprising:

a continuous ribbon slab having a plurality of flights fabricated from concrete and being defined by an inner perimeter; and wall panels attached to the inner perimeter of the ribbon slab between the top and the bottom.

2. A subterranean structure, comprising:

a continuous ribbon slab having a plurality of flights fabricated from concrete, the ribbon slab defining periodic openings therein which generally align between adjacent flights, and wherein the flights are separated by a slab interval, the structure further comprising a fill material located in the slab interval.

3. A subterranean structure, comprising:

a continuous ribbon slab having a plurality of flights fabricated from concrete, the ribbon slab defining periodic openings therein which generally align between adjacent flights, and wherein the periodic openings which are generally aligned between adjacent flights define a caisson; and the structure further comprising a plurality of caisson liners, each caisson liner being located within an associated caisson.

4. The subterranean structure of claim 3–4, and wherein the caisson liners are filled with a fill material.

5. A subterranean structure, comprising:

a continuous ribbon slab having a plurality of flights fabricated from concrete, the ribbon slab defining periodic openings therein which generally align between adjacent flights, and wherein the flights are defined by an outer perimeter and an inner perimeter; and the structure further comprising outer sheet piling located at the outer perimeter of the flights and between adjacent flights.

6. The subterranean structure of claim 5, and further comprising inner sheet piling located at the inner perimeter of the flights and between adjacent flights.

7. The subterranean structure of claim 5, and further comprising a concrete wall attached to the outer sheet piling and facing the inner perimeter of the flights.

8. The subterranean structure of claim 7, and further comprising outer inner sheet piling located at the inner perimeter of the flights and between adjacent flights.

9. The subterranean structure of claim 8, and further comprising a concrete wall attached to the inner sheet piling and facing the inner perimeter of the flights.

10. The subterranean structure of claim 7, and further comprising a concrete wall attached to the continuous ribbon slab at the inner perimeter of the flights.

* * * * *